US008322723B1

(12) United States Patent
Bancel et al.

(10) Patent No.: US 8,322,723 B1
(45) Date of Patent: Dec. 4, 2012

(54) SYSTEM AND METHOD FOR PROVIDING AND MANAGING A COMPETITIVE PUZZLE-BASED GAME HAVING AT LEAST ONE RISK ELEMENT

(75) Inventors: Chris Bancel, Ridgefield, CT (US); Rich Allen, Houston, TX (US); Jonathan Avery, Houston, TX (US)

(73) Assignee: Blonde Lab, LLC, Houston, TX (US)

( * ) Notice: Subject to any disclaimer, the term of this patent is extended or adjusted under 35 U.S.C. 154(b) by 0 days.

(21) Appl. No.: 13/546,864

(22) Filed: Jul. 11, 2012

Related U.S. Application Data

(63) Continuation-in-part of application No. 12/720,560, filed on Mar. 9, 2010, now abandoned, which is a continuation-in-part of application No. PCT/US2011/062698, filed on Nov. 30, 2011.

(60) Provisional application No. 61/158,700, filed on Mar. 9, 2009, provisional application No. 61/417,922, filed on Nov. 30, 2010.

(51) Int. Cl.
*A63F 3/00* (2006.01)
*A63F 9/12* (2006.01)

(52) U.S. Cl. ..... 273/274; 273/272; 273/153 R

(58) Field of Classification Search ..... 273/153 R, 273/156, 157 R, 440, 447, 274, 276
See application file for complete search history.

(56) References Cited

U.S. PATENT DOCUMENTS

| | | | | |
|---|---|---|---|---|
| 3,876,207 | A * | 4/1975 | Jones | 273/239 |
| 4,133,538 | A * | 1/1979 | Ambrose | 273/276 |
| 4,417,732 | A * | 11/1983 | Guill | 273/238 |
| 6,193,234 | B1 * | 2/2001 | Jones | 273/157 R |
| 6,988,948 | B2 * | 1/2006 | Perrie et al. | 463/25 |
| 7,427,235 | B2 * | 9/2008 | Anderson et al. | 463/16 |
| 7,566,271 | B2 * | 7/2009 | Hostetler et al. | 463/25 |
| 7,766,739 | B2 * | 8/2010 | Kane et al. | 463/17 |
| 7,771,265 | B2 * | 8/2010 | Perrie et al. | 463/18 |
| 2008/0182664 | A1 | 7/2008 | Kaplan et al. | |
| 2009/0011825 | A1 | 1/2009 | Lima | |
| 2009/0280891 | A1 | 11/2009 | Filipour et al. | |
| 2010/0093444 | A1 | 4/2010 | Biggar | |
| 2010/0222121 | A1 | 9/2010 | Holmes et al. | |
| 2010/0252994 | A1 | 10/2010 | Bancel | |

* cited by examiner

*Primary Examiner* — William Pierce
(74) *Attorney, Agent, or Firm* — Edward Etkin, Esq.

(57) ABSTRACT

A puzzle-based game system and method, having at least one risk element (e.g., wagering), is provided, enabling players to compete in a puzzle-based game of skill utilizing a system of risk-element-based rules, that are applied in a predetermined manner to: first partition a set of puzzles into a predefined plurality of puzzle elements, thereafter "dealing" the puzzle elements sequentially in a "round by round" sequence, and enabling, during at least a portion of the total game rounds, each player to selectively take one or more predefined risk-based actions (such as placing a wager), during a predefined time in each "risk" (e.g., wagering) round. The inventive system and method may also include an optional system and method enabling provision and management of dynamic online game environments and related infrastructures advantageously usable in plural multi-player online games having social interaction and competitive aspects, and utilizing virtual currency, with optional educational applications.

30 Claims, 21 Drawing Sheets

295A

295B

400

WORLD VIEW

450

REGION VIEW

500

REGION VIEW (Region Ruler)

550

CITY VIEW

600

CITY VIEW (City Founder)

650

CITY VIEW (Game "Lobby")

SYSTEM AND METHOD FOR PROVIDING AND MANAGING A COMPETITIVE PUZZLE-BASED GAME HAVING AT LEAST ONE RISK ELEMENT

CROSS REFERENCE TO RELATED APPLICATIONS

The present patent application is a continuation-in-part of, and claims priority from, the commonly assigned co-pending U.S. patent application Ser. No. 12/720,560 entitled "PUZZLE-BASED WAGERING GAME SYSTEM AND METHOD", filed Mar. 9, 2010, which in turn claims priority from the commonly assigned co-pending U.S. Provisional Patent Application Ser. No. 61/158,700, entitled "PUZZLE-BASED WAGERING GAME SYSTEM AND METHOD", filed Mar. 9, 2009, is a continuation-in-part of, and also claims priority from, the commonly assigned co-pending International Patent Application No. PCT/US11/62698, entitled "SYSTEM AND METHOD FOR PROVIDING AND MANAGING A COMPETITIVE PUZZLE-BASED GAME HAVING AT LEAST ONE RISK ELEMENT", filed Nov. 30, 2011, which in turn claims priority from the commonly assigned U.S. Provisional Patent Application Ser. No. 61/417,922, entitled "SYSTEM AND METHOD FOR PROVIDING AND MANAGING A DYNAMIC ONLINE GAME ENVIRONMENT AND INFRASTRUCTURE", filed Nov. 30, 2010.

FIELD OF THE INVENTION

The present invention relates generally to puzzle-based and skill-based games, as well as to games having at least one risk-based element (such as wagering games), and more particularly to a system and method of selectively combining predetermined elements and rules from puzzle-based games, skill-based games, and games having at least one risk element, to design, implement, and offer a new novel class of games that are each playable by at least one player in a competitive manner, and that each comprise at least one puzzle game component partitioned into a plurality of sequential game rounds, coupled with at least one risk element (such as, for example, wagering) offered during each of at least a portion of the rounds.

BACKGROUND OF THE INVENTION

Throughout the ages games of skill and chance have always enjoyed a consistently high level of popularity, which has only grown during the past century as industrial revolution, and subsequent ever-growing technological and scientific advances, have provided the populace with greater and greater amounts of leisure time available to play various games.

While there are a vast number of different types of games, among the most popular and addictive, are "puzzle-based" games. Before proceeding further, it would be helpful to provide simplified definitions of games and puzzles and of their key characteristics:

1) A "game" can generally be defined as "a physical or mental competition conducted according to rules, with the participants in direct competition to each other". In terms of some of its key characteristics, a typical game:
   a) is designed for a plurality of players; and
   b) has a commercial value that is reflected in its adoption i.e., the more satisfying a game is to play, the more people play it, i.e., a greater level of adoption, equates to greater commercial value.
2) A "puzzle" can generally be defined as "a question, problem or contrivance designed for testing ingenuity." In terms of some of its key characteristics, a typical puzzle:
   a) is designed for use by a single person,
   b) derives its intrinsic value from the satisfaction one receives upon successful completion (of a question, problem or contrivance), where a puzzle's adoption is inversely proportional to intrinsic value. The more difficult a puzzle is to complete, the fewer people complete it (i.e. leading to a lesser degree of adoption), while the more difficult a puzzle is to complete, the greater the satisfaction received (e.g., the intrinsic value) upon completion.

Puzzle-based games combine varying amounts of the above-described game and puzzle characteristics and may be generally separated into three categories as follows:

1) Pattern matching puzzles (PMPs): which present the player with a list of patterned elements (words, symbols, colors, etc.). The player is then challenged to find (e.g., "match") identical patterns of in a larger field made up of similar pattern elements. Word-search is an example of a pattern matching puzzle;
2) Pattern completion puzzles (PCPs): which present the player with a field (e.g., a grid) of incomplete patterns and challenge the player to complete the patterns in accordance with a set of predetermined rules known to the player. Sudoku, Rubik's Cube, Chinese Picture Puzzles and Scrabble are examples of pattern completion puzzles; and
3) Combination puzzles (PMP/PCP): which present a combination of both pattern matching and pattern completion challenges. Jig-saw and crossword puzzles are examples of such combination puzzles.

As can be readily seen from above, the greatest challenge in designing a successful puzzle-based game is the fact that a puzzle-based game built using difficult/high intrinsic value puzzles will result in lower adoption rates—i.e., the more and rewarding the game, the smaller amount of people will be interested in playing it. Of course there are a number of other very significant challenges in designing and providing a successful puzzle-based game. These challenges include, but are not limited to, the following:

1) Puzzles do not lend themselves to being implemented in games without the addition of rules, over and above the basic rules inherent in an individual puzzle;
2) Puzzles are binary—meaning that a typical puzzle can only be classified as "complete/solved" or "incomplete/unsolved";
3) When the embodiment of a puzzle game is implemented as an application on a personal computer based or other data processing platform, puzzle-solving software may be employed to solve, or circumvent, the puzzles that are used as the basis of the game;
4) When puzzles that are used as the basis of a game for a plurality of players are too simple, the resulting gameplay is non-satisfying (e.g., resulting in too many "ties");
5) When puzzles that are used as the basis of a game for a plurality of players are too complex, the resulting gameplay is non-satisfying. (games take too long, less skillful players become frustrated);
6) When a time-element is employed in a puzzle-based game, and the when the winner thereof, determined from a plurality of players, is based on whoever completes a puzzle first, the resulting game-play is one-dimensional and non-satisfying (i.e., the most skillful players usually win); and 7) When all puzzles that are used as the basis of a game for a plurality of players are identical, the resulting game-play is one dimensional and non-satisfying.

It would thus be desirable to provide a novel and versatile system and method for selectively combining predetermined elements and rules from puzzle-based games, skill-based games, and wagering games, to form a plurality of a new novel class of platform-independent games playable by at least one player in a competitive manner comprising skill, puzzle, and wagering components, with an optional addition of the element of time.

It should also be noted that throughout the ages games of skill and chance have always enjoyed a consistently high level of popularity, which has only grown during the past century as industrial revolution, and subsequent ever-growing technological and scientific advances, have provided the populace with greater and greater amounts of leisure time available to play various games.

Among the most significant game-related technological advances of the past two decades have been the implementation, and rapid proliferation, of many well-known games of different types in an Internet-based (or "online") gaming environment. Such "on-line" game incarnations have included, but have not been limited to: small-group or player vs. computer skill/luck wagering games (e.g., poker, other card games), collaborative "networked" multi-player versions of previously single-player computer/console games (such as "first-person-shooters", etc.), massive multiplayer online role-playing/strategy games with up to hundreds of thousands of players participating in richly developed online game environments on a long-term ongoing basis, as well as online versions of conventional single-player games of skill, such as puzzle-based games (e.g., Sudoku, Wordsearch, etc.).

In recent years, exponential increases in popularity and utilization of online (and cross-platform capable (e.g., mobile device)) social networking platforms (such as Facebook, etc.), as well as Internet-based (or "online") gaming, has resulted in explosive growth of an entirely new category of online games, commonly referred to as "casual games" that typically comprise easy to use and learn games that are playable in conjunction with user utilization of one or more compatible social networking platforms, and that typically rely on at least some social networking features of the platforms' to interact with other designated players associated with the user therethrough. A good number of such casual games revolve around resource management and selection of simplified strategic options, while many other casual games offer gameplay based in whole or in part on well known games long-available in other formats (such as simplified online poker and equivalents).

Casual online games have also become very valuable properties, because many casual games include "virtual in-game currency" features that make the games very profitable for companies offering them, at least in part because they essentially and legally circumvent the regulatory restrictions on online gambling, by instead selling non-redeemable virtual currency (usable in-game) to the players.

However, typical casual game offerings provide little satisfaction to most users and often fail to hold user interest for an extended period of time, instead relying on user turnover. Moreover, most currently available competitive online games (and especially turn-based multi-player games (such as many casual games), suffer from a common core drawback. Joining a typical online turn-based game (such as a poker game) requires players to first undergo a frustrating and time-consuming process of locating a game session (e.g. a "table") with an available slot (e.g., "seat"), and then joining it. Moreover, organizing a new game session is typically an even more time consuming and frustrating experience. While many game companies have tried to simplify these processes, their attempted solutions are typically little more than afterthoughts, most commonly comprising virtual "lobbies" or equivalents deployed en masse on different servers, with scrollable lists of active and available games. Moreover, the huge number of players of such games results in many game companies offering game selection interfaces with scrollable lists of literally thousands of game sessions making the game selection and joining process even more frustrating and difficult.

Accordingly the majority of users tend to select any game session that is available with little interest or emotional investment (other than the session's parameters (e.g., the stakes—the amount of currency that one needs to bring to the table) in a particular game session itself. In short, the processes of locating and selecting a game session is a "necessary evil" that does not positively impact, or add value to, the user's gameplay experience.

It would thus also be desirable to provide a novel and versatile system and method for providing and managing an online game environment and related infrastructure that may be readily adapted and configured for advantageous utilization and implementation therein of different multi-player online games in which the processes of selection by players of particular virtual gameplay sites for entry into, and participation in, one or more games offered therein, are seamlessly incorporated into the game environment and infrastructure as integral aspects of overall "gaming experience" and that offer users a separate layer of gameplay in the utilization thereof.

BRIEF DESCRIPTION OF THE DRAWINGS

In the drawings, wherein like reference characters denote corresponding or similar elements throughout the various figures.

SUMMARY OF THE INVENTION

Figure 1:
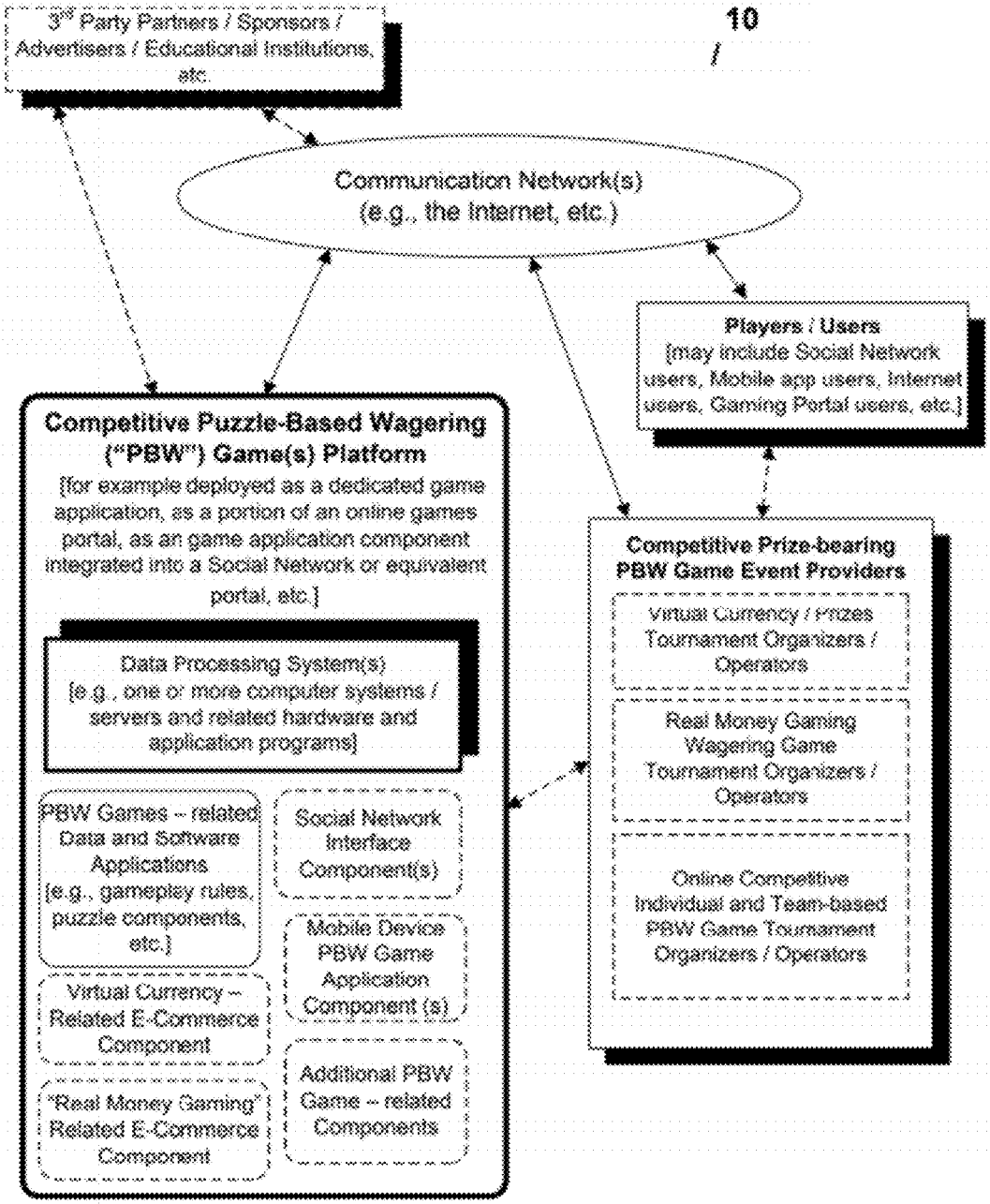
FIG. 1 shows an exemplary schematic block diagram illustrating a first exemplary embodiment of the inventive system for providing and managing competitive puzzle-based games comprising a combination of at least skill, puzzle, and risk elements, implemented, by way of example in at least one data processing system connected to at least one communications network.

The present invention provides a puzzle-based game system and method, having at least one risk element (such as wagering component), that advantageously enable a player to compete, in at least one embodiment thereof, against at least one other opposing player in a puzzle-based game (such as a game of skill) utilizing various inventive embodiments of the novel system of risk-element-based rules, that are applied in a predetermined manner (in accordance with the type of puzzle-based game being played) to:

(1) first partition each set of puzzles intended for the players, into a predefined plurality of puzzle elements, such that the puzzle elements may then be sequentially "dealt" to the players through a series of "rounds", and thereafter, (2) dealing the puzzle elements in a round by round sequence as the game progresses, and (3) enabling, during at least a portion of the total game rounds, each player to selectively take one or more predefined risk-based actions (such as placing a predetermined wager), during a predefined time in each "risk" (e.g., wagering) round (such as at the onset thereof).

In at least one embodiment thereof, the inventive system and method are operable to provide an additional time-limit element (and/or at least one other rule element comprising at least one constraint on player actions), during each of at least a portion of the total game rounds. Furthermore, in various embodiments of the present invention, the at least one opposing player is selected from a group comprising: at least one human opponent, and/or at least one "computer" (e.g., "program-instructions-controlled") opponent, and/or combinations of human and computer opponents.

Advantageously, the inventive game system and method may be readily implemented, in whole or in part, as a matter of design choice, without departing from the spirit of the invention, utilizing a wide variety of game components and/or platforms (ranging from paper/pencil/token/dice games to full standalone, or preferably to networked application software programs (including, but not limited to Internet websites, and/or website application (or equivalent) components/modules) executable on one or more data processing systems (e.g., mobile phones, personal computers, etc.), and most preferably deployed as multi-player software gaming applications that may be provided through one or more Internet websites and/or portals, and/or that may be integrated into various social networking platforms (e.g., implemented as a "Facebook App", etc.).

In additional embodiments thereof, the present invention is also directed to a system and method that enable provision and management of a dynamic online game environment and related infrastructure that may be readily adapted and configured for advantageous utilization and implementation therein of plural multi-player online games having at least social interaction and competitive aspects, and incorporating utilization of virtual in-game currency, where in various inventive embodiments of the provided game environment/infrastructure, the processes of player selection of particular virtual gameplay sites for entry into, and participation in, one or more games offered therein, as well as user-centric gameplay site organization and management features, are seamlessly incorporated into the game environment and infrastructure as integral aspects of overall "gaming experience", also offering additional layers of aspects strategic, social, and business-based gaming experiences to interested users that are synergistic with, but that may be enjoyed separately from, the offered games themselves, thus complementing and greatly improving user enjoyment of various offered games and enhancing the user experience.

This novel approach also offers multiple types of player hierarchies and corresponding advancement paths, such as: (1) social/business centric paths for players interested in increasing their social status in the overall game environment, and/or in maximizing their ability to generate and acquire virtual game currency (e.g., by acquiring, developing, promoting, and growing multiple successful gameplay sites offering various games to other players), and/or (2) gameplay achievement paths for players interested in achieving rewards (e.g., in-game renown, acquisition of virtual game currency) through successes in competitive gameplay and advancement in game rankings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION OF PREFERRED EMBODIMENTS

In the main exemplary embodiments thereof, the system and method of the present invention addresses the flaws and disadvantages of previously known gaming solutions, by providing a novel series of gameplay and related methods, gameplay rules, and other game elements to enable design, configuration, and provision of a plurality of novel class of games that are advantageously playable by at least one player in a competitive manner, and each comprising a combination of at least skill, puzzle, and wagering components.

The present invention provides a puzzle-based wagering game system and method that advantageously enable a player to compete, in at least one embodiment thereof, against at least one other opposing player in a puzzle-based game (such as a game of skill) utilizing various inventive embodiments of the novel system of wagering rules that are applied in a predetermined manner (in accordance with the type of puzzle-based game being played) to first partition each set of puzzles intended for the players, into a predefined plurality of puzzle elements, such that the puzzle elements may then be sequentially "dealt" to the players through a series of "rounds", and thereafter, dealing the puzzle elements in a round by round sequence as the game progresses, and enabling, during at least a portion of the total game rounds, each player to place a predetermined wager during a predefined time in each wagering round (such as at the onset thereof).

In at least one embodiment thereof, the inventive system and method are operable to provide an additional time-limit element (and/or at least one other rule element comprising at least one constraint on player actions), during each of at least a portion of the total game rounds. In various embodiments of the present invention, the at least one opposing player is selected from a group comprising: at least one human opponent, and/or at least one "computer" (e.g., "software-controlled") opponent, and/or combinations of human and computer opponents.

Advantageously, the inventive game system and method is platform-independent in that its various embodiments may be readily implemented, in whole or in part, as a matter of design choice, without departing from the spirit of the invention, utilizing a wide variety of game components and/or platforms (ranging from paper/pencil/token/dice games to full standalone or preferably networked application software programs executable on one or more data processing systems (e.g., mobile phones, personal computers, etc.).

Referring now to FIG. 1, an exemplary schematic block diagram illustrating a first exemplary embodiment of an inventive system/infrastructure 10 for providing and managing competitive puzzle-based games comprising a combination of at least skill, puzzle, and risk elements, implemented, by way of example in competitive puzzle-based wagering game platform that comprises at least one data processing system that is connected to at least one communications network (the dashed lines in FIG. 1 indicating optional system components).

In various exemplary embodiments thereof, the system and method of the present invention may include at least one, and preferably a combination of at least a portion of, the following advantageous exemplary novel methods, rules, and game elements:

1) Application of a turn-based wagering system to a puzzle-based game. Each player is "dealt" a puzzle at the onset of play (this can be called a "hand"). Each hand is split into multiple "rounds". Each round is preceded by wagering amongst players as to the final outcome of the hand.
2) Application of a "time element" or equivalent rules constraint to a puzzle-based game. Each round within a hand is active for a predetermined amount of time. While a round is active, players may work to complete their puzzles. During the wagering portion of a round, players may not work on their puzzles.
3) Application of differing puzzles with common elements to a puzzle-based game. Puzzles dealt for each hand are not identical but do contain an element or elements common to all players.
   a) Example 1: If the puzzles used in a game are classified as pattern matching puzzles (pmp) i.e., word-search, each player will be tasked with finding a set of words (patterns) common to all players but placed differently in each puzzle.
   b) Example 2: If the puzzles used in a game are classified as pattern completion puzzles (pcp) i.e., Sudoku, every player's puzzle will be the same size, contain the same number of initial cells completed, and the number-set used in the initial completed cells will be identical for each player. However, the initial cells completed and presented in each individual player's puzzle will be placed at different positions forming a different pattern in each puzzle thereby changing the intrinsic value of each puzzle i.e., some puzzles will be more difficult to solve than others. Finally, at the outset of each hand, each individual puzzle's completed cells will be indicated and viewable by all players, but the value of these cells will be hidden. All players will see the patterns formed by initial completed (but hidden) cells of all other players. During subsequent rounds of play, the values assigned to the Completed cells may be revealed—round by round—to each individual player and the puzzle as a whole will be blocked from view by all players, except the player assigned to the puzzle in question. In other words, after the initial round(s) player A will no longer be able to see the progress made by each of the other players' B, C, D, E's, etc., in their respective puzzles.
4) In the case where pattern completion puzzles are used, the inventive game system and method may at least in part comprise puzzles without a solution.
5) Regardless of the class of puzzle used in the novel puzzle-based wagering game, and given that each puzzle dealt in a hand is different (but with a set of common elements) each puzzle can be assigned a different value for completion. With a value assigned to each puzzle for completion, a value may also be assigned for partial completion thereby eliminating the need to complete any puzzle in full in any given hand.
6) Puzzles used for the novel puzzle-based wagering games built on pattern completion (pcp) principles are not revealed in their entirety at the outset of the game (advantageously this prevents the use of electronic/computer based puzzle solvers)—see Example 2, above.
7) When the embodiment of the game is based on a personal computer and/or the Internet, the novel puzzle-based wagering games are presented to the end user in a manner that prevents the user from copying and pasting the game puzzles into an electronic puzzle solver.
8) During the initial round(s) of a hand in the novel puzzle-based wagering game, all puzzles are visible as well as the progress each player is making toward completion of his or her puzzle.
9) During the final round(s) of play the in the novel puzzle-based wagering game, all puzzles are hidden. This encourages players to bluff their bets, guess what another players progress may be and shifts the focus of the game from puzzle completion to the risk one is willing to take with his or her accumulated chips, tokens or points. In summary, based on incomplete information the player must place a wager based on the strength of his or her hand in relation to what he or she "thinks" the value of his or her opponent's hands may be.
10) Because each hand dealt in a novel puzzle-based wagering game contains non-identical puzzles (but with an element common to all players), each puzzle can carry a different intrinsic value. Some puzzles may be harder (worth more) than others. This method can be equated to a hand in a game of cards such as Texas Hold'em where each player receives two private cards (hole cards) and every player has access to five cards placed at the center of the table (community cards).

In summary, in accordance with at least a portion of the various embodiments of the present invention, in order to advantageously utilize one or more puzzles, in accordance with the system and method of the present invention, as a successful basis of a competitive turn-based game capable of supporting the wagering game component, the puzzle's intrinsic value is preferably selected and configured to shift from the satisfaction derived from successful completion, to the value received for successfully overcoming competitors (which may or may not involve successful completion of a given puzzle).

The above "value received" may be readily supplied by the wagering component portion of the game in the form that depending on the platform of the game's implementation—e.g., physical chips or tokens, which may or may not have real monetary value, as well as "points", virtual currency (or equivalent, such as "micro-commerce" in-game "cash"), or real currency in electronic form (such as with online "real money" card/casino, etc. wagering games). In short, such as with a game of poker, "winning" becomes a matter of acquiring and accumulating an opponent's chips, points, tokens, or equivalent, over time rather than just the successful completion of a series of puzzles.

Figure 2:
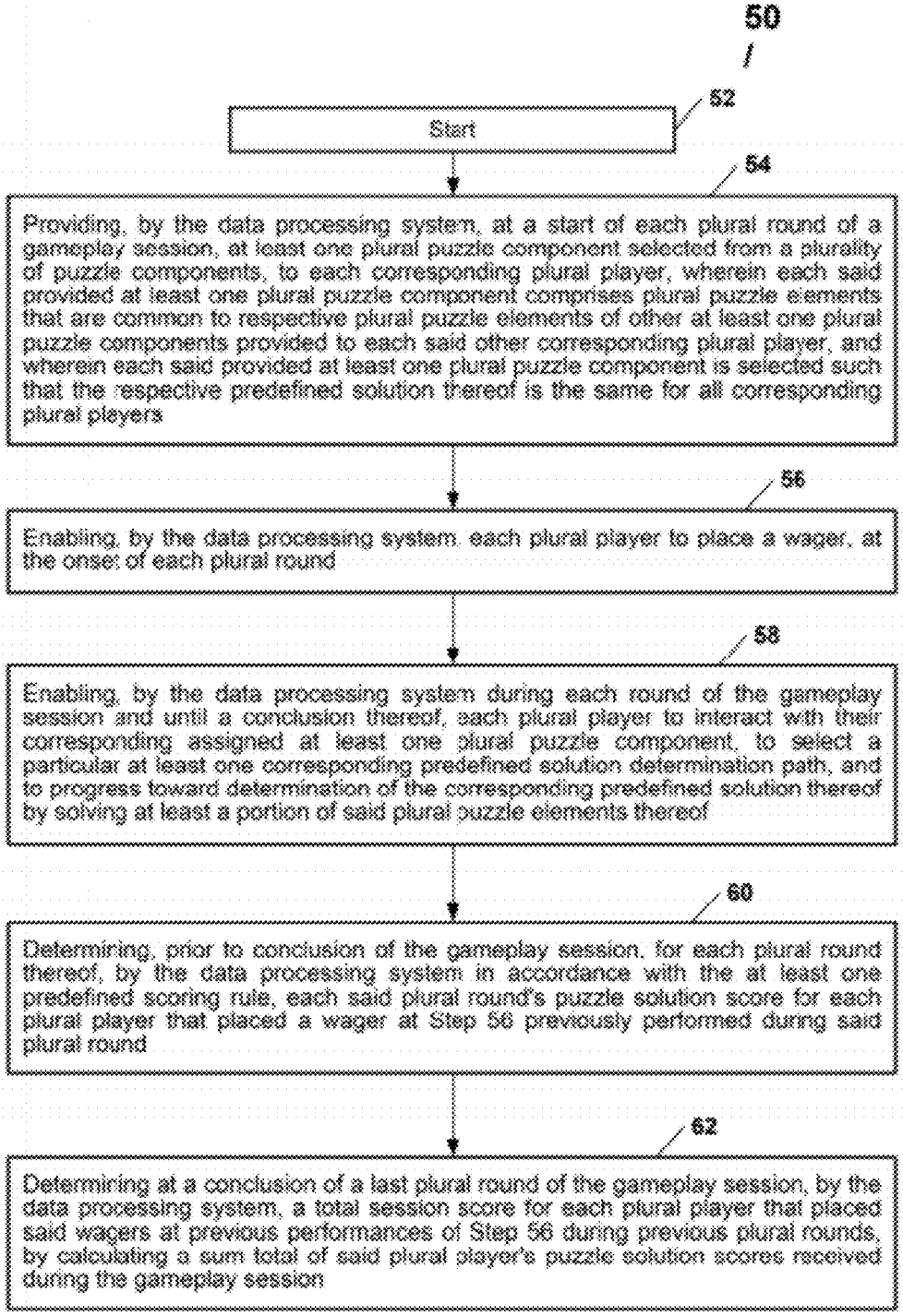
FIG. 2 is an exemplary schematic diagram illustrating an exemplary embodiment of a process flow representative of the game method of the present invention implemented through operation of the exemplary inventive system of FIG. 1.

Referring now to FIG. 2, an exemplary schematic diagram illustrating an exemplary embodiment of a process flow representative of at least one novel puzzle-based wagering ("PBW") game method 50 of the present invention, that may be implemented through operation of the exemplary inventive system 10 of FIG. 1. The exemplary inventive PBW game method 50 may be readily utilized with pattern matching puzzle components, pattern completion puzzle components, and combinations of pattern matching and pattern completion puzzle components. The PBW game method 50 started at a step 52 and continues through step 62, with each step being performable by a data processing system, such as illustrated in the system 10 of FIG. 1, above.

By way of example only, and not to limit the scope of the inventive system and method in any manner whatsoever, below are presented various exemplary advantageous embodiments of the system and method of the present invention, or the sole purpose to illustrate the various features, components and elements thereof of just several of a plurality of contemplated advantageous implementable embodiments of the present invention. Furthermore, with respect to the "Materials/game elements required" section of each exemplary embodiment description, it should be noted that in view of the platform-independent nature of the inventive game system and method, any physical, electronic, or virtual equivalent of any listed material can be readily substituted when the appropriate support elements are made available—for example, in a full software-implementation platform, the listed "Materials/game elements required" can be readily substituted for their virtual equivalents: e.g., suitable writing instruments, paper, and a timer may be computer game user interface/game functions, while chips may be points, and a dictionary may be a function accessible from the game's user interface.

Exemplary Embodiment #1: Pattern Matching Game/Word-Search Puzzle

Figure 3A:
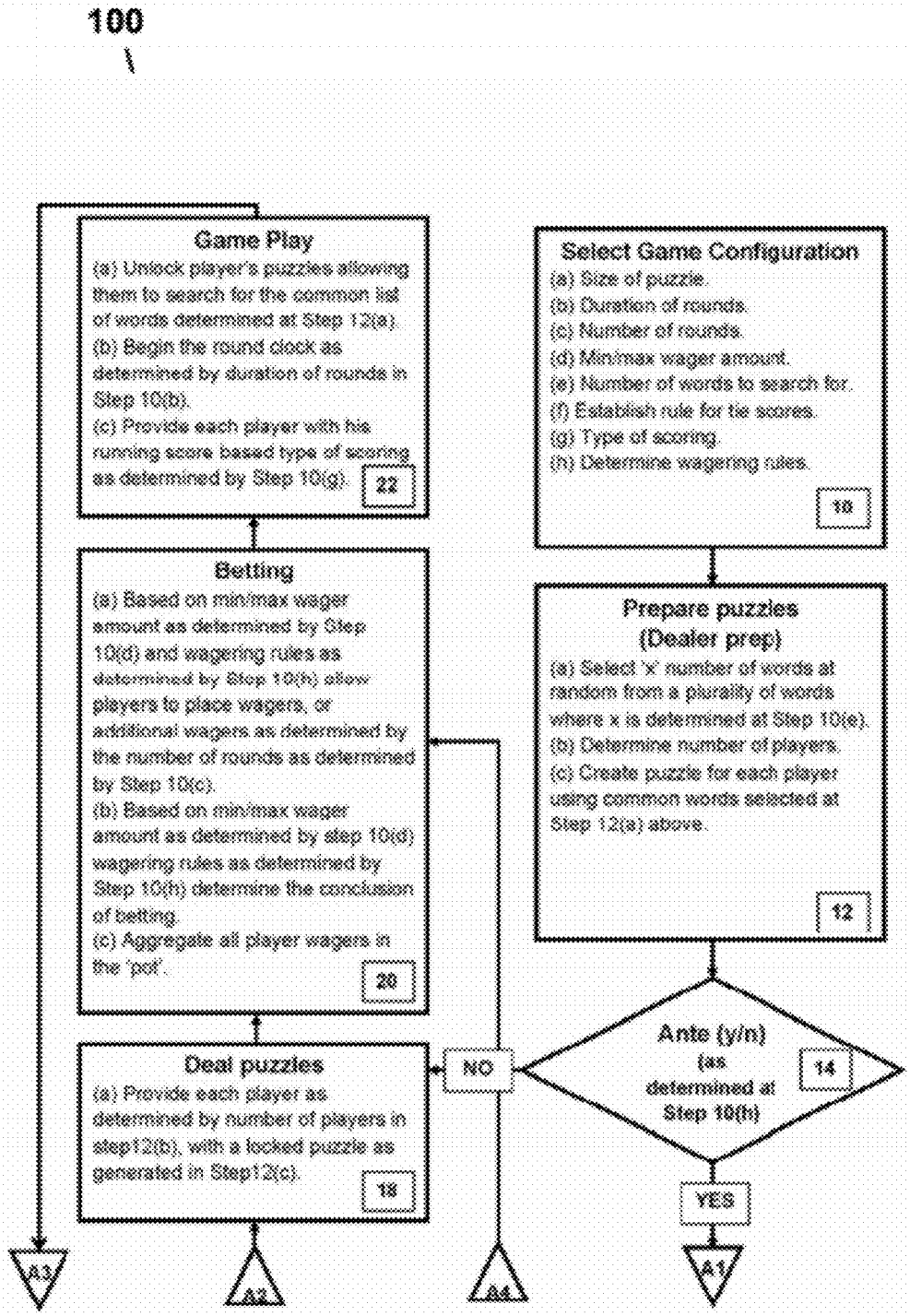
FIGS. 3A-3C are exemplary schematic diagrams illustrating process steps representative of a first exemplary alternate embodiment of the inventive game method of FIG. 2, implemented utilizing "pattern recognition" type puzzle components and elements.
Figure 3B:
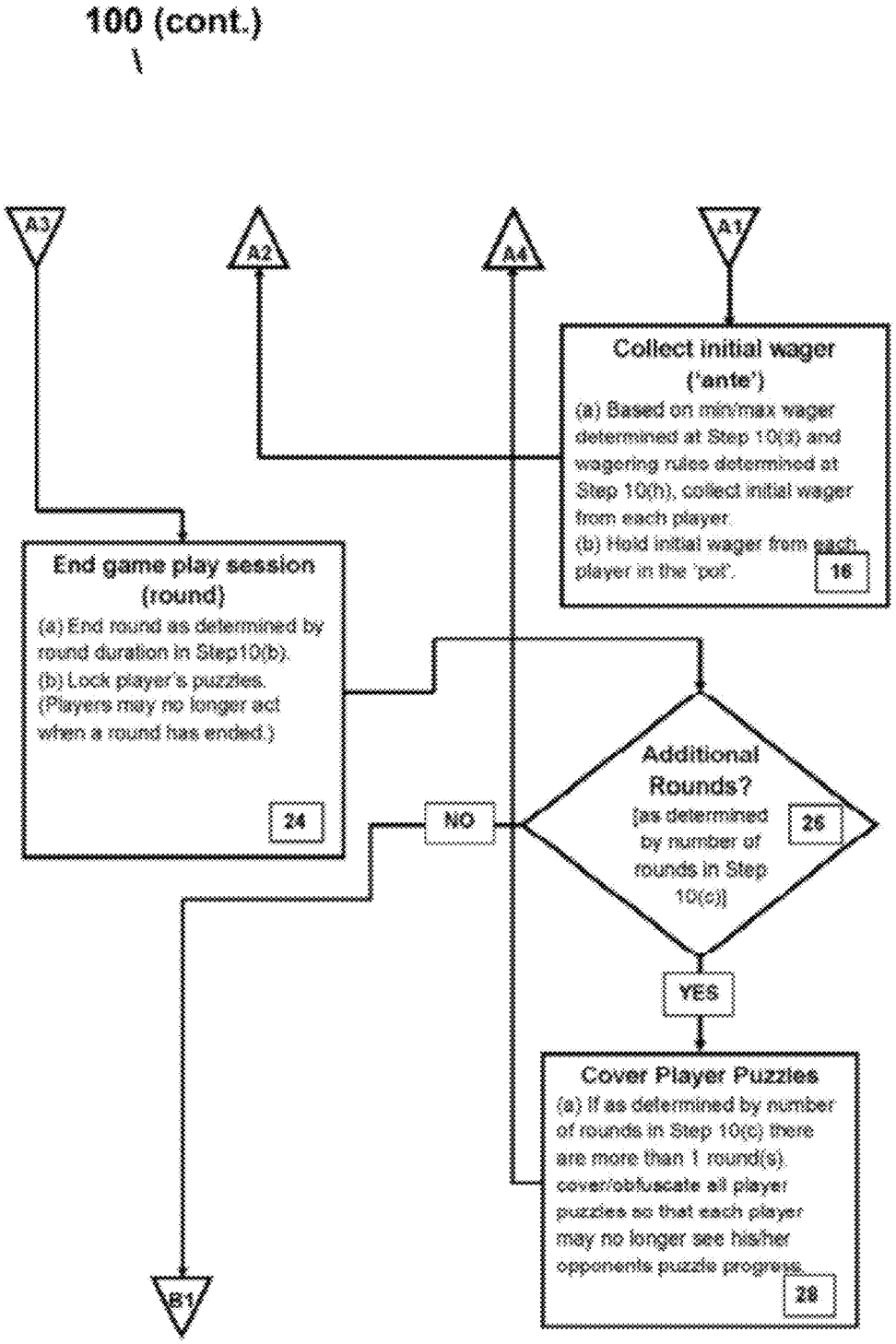
Figure 3C:
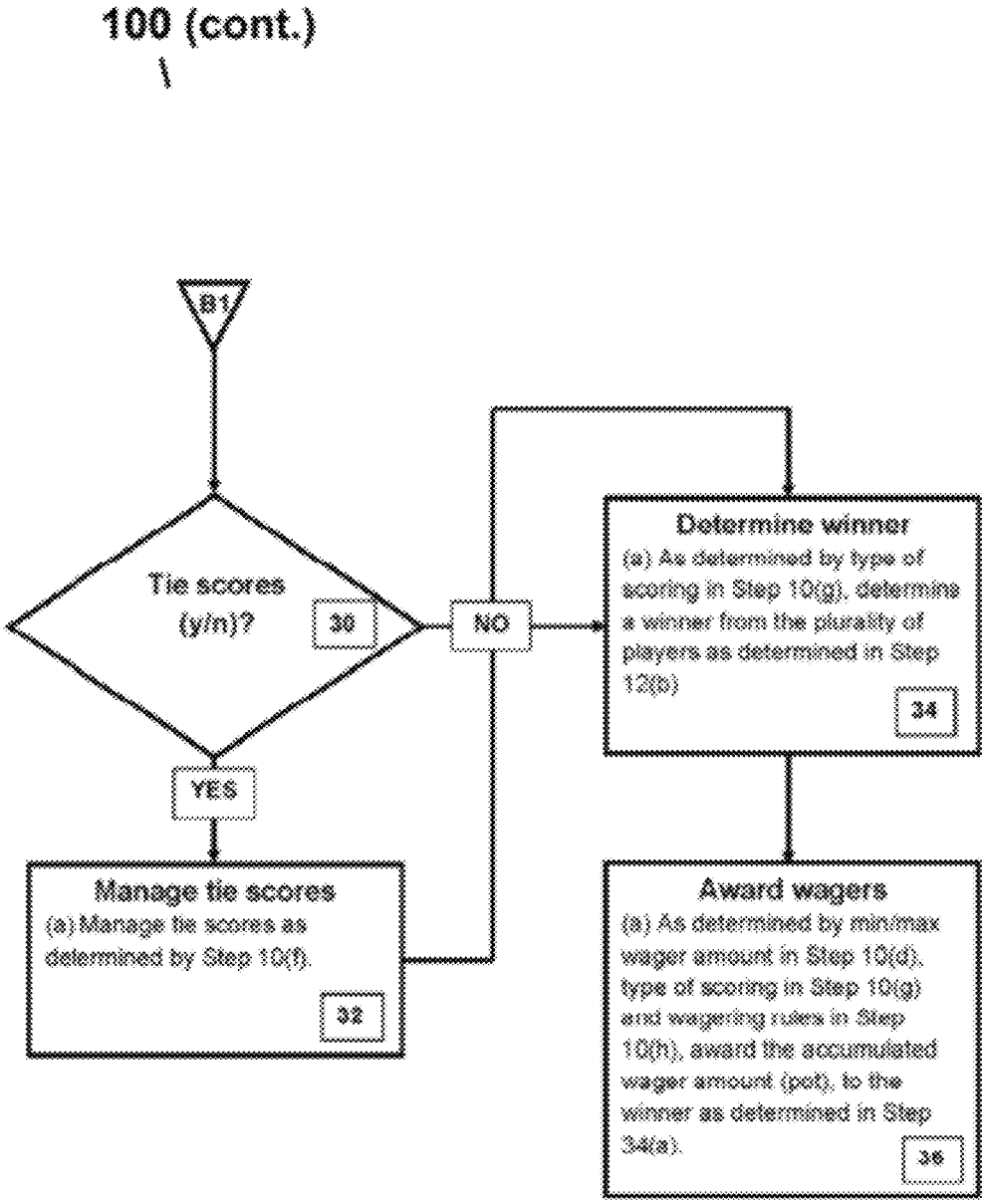
Figure 4A:
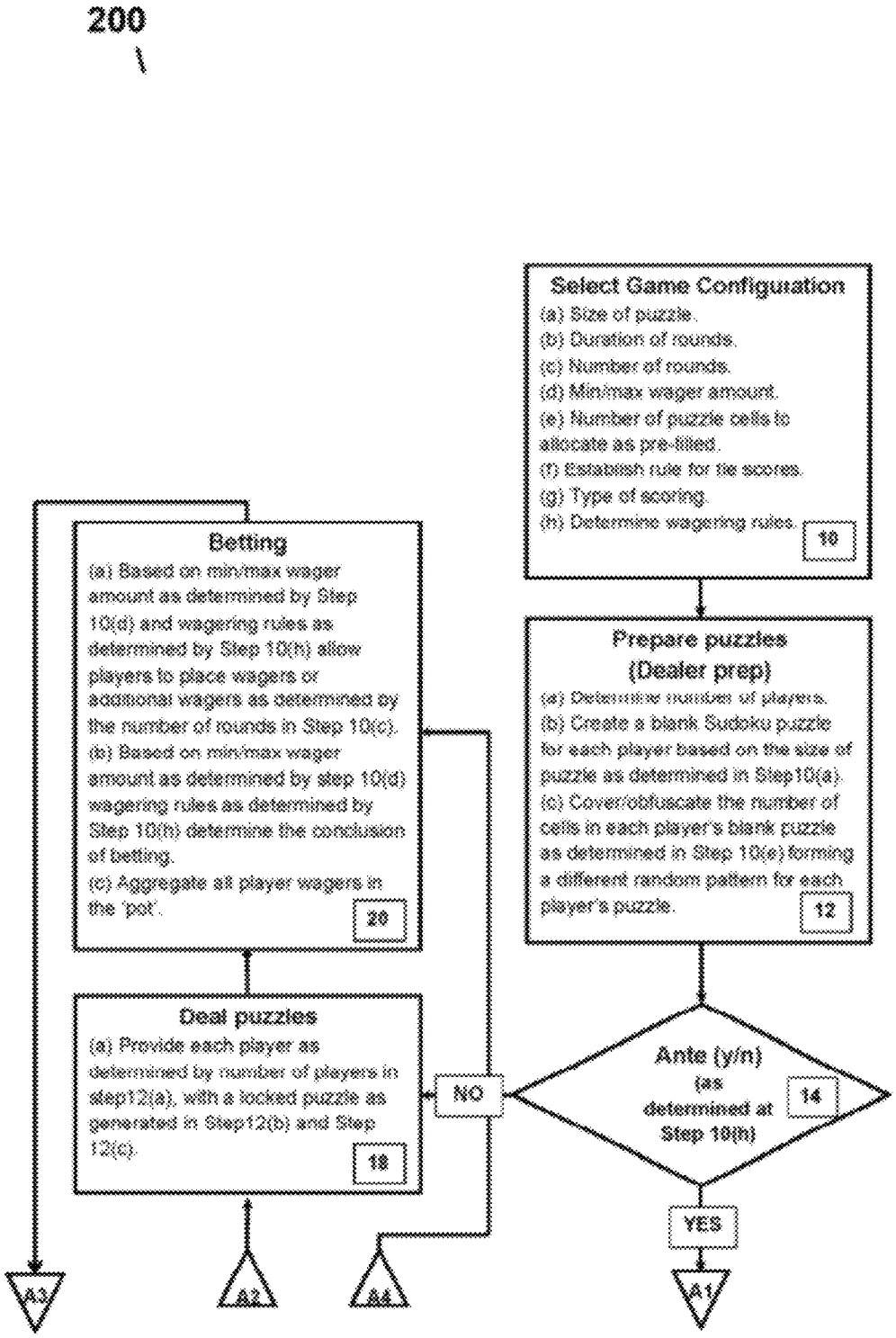
FIGS. 4A-4D are exemplary schematic diagrams illustrating process steps representative of a second exemplary alternate embodiment of the inventive game method of FIG. 2, implemented utilizing "pattern completion" type puzzle components and elements.
Figure 4B:
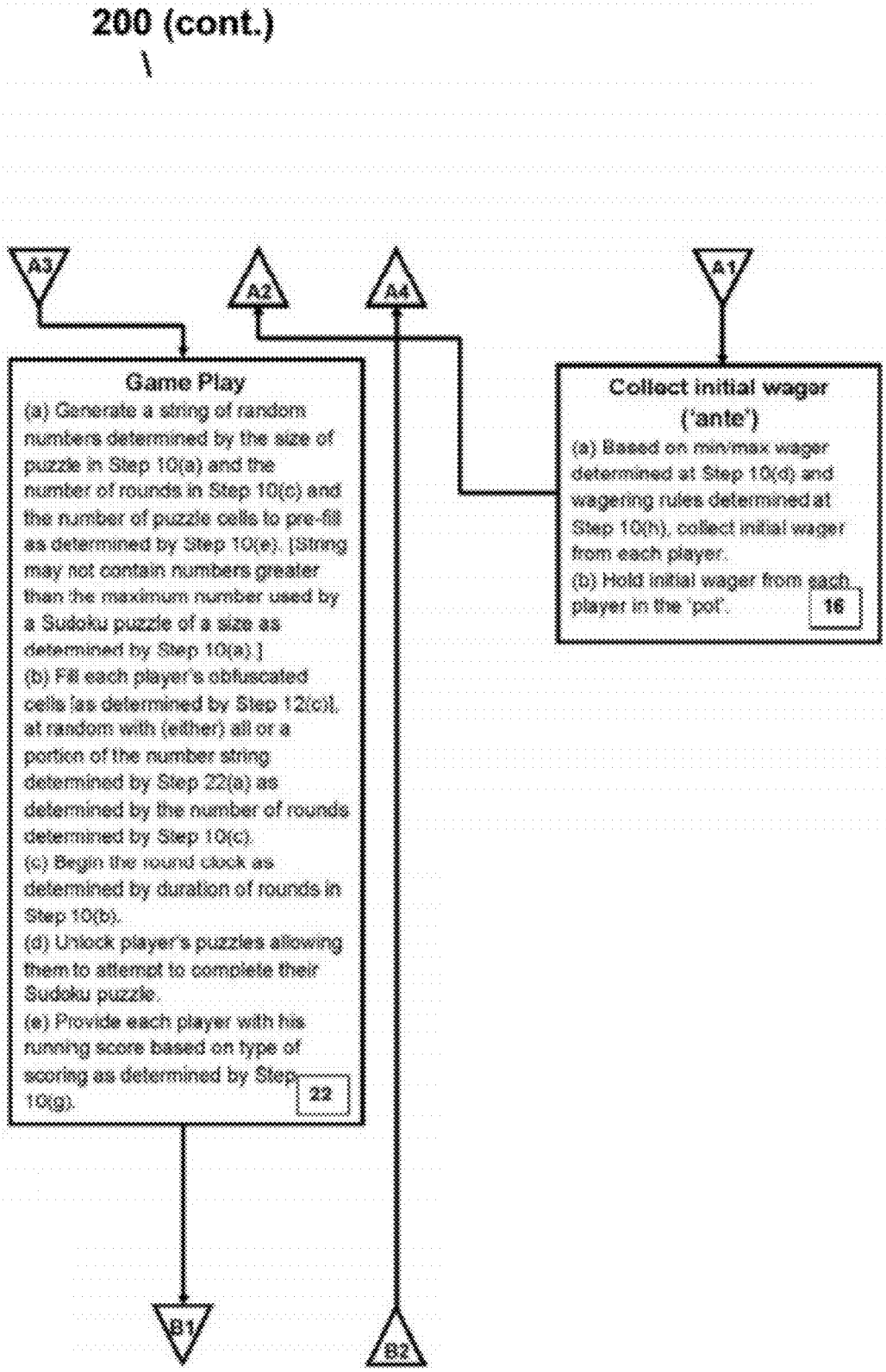
Figure 4C:
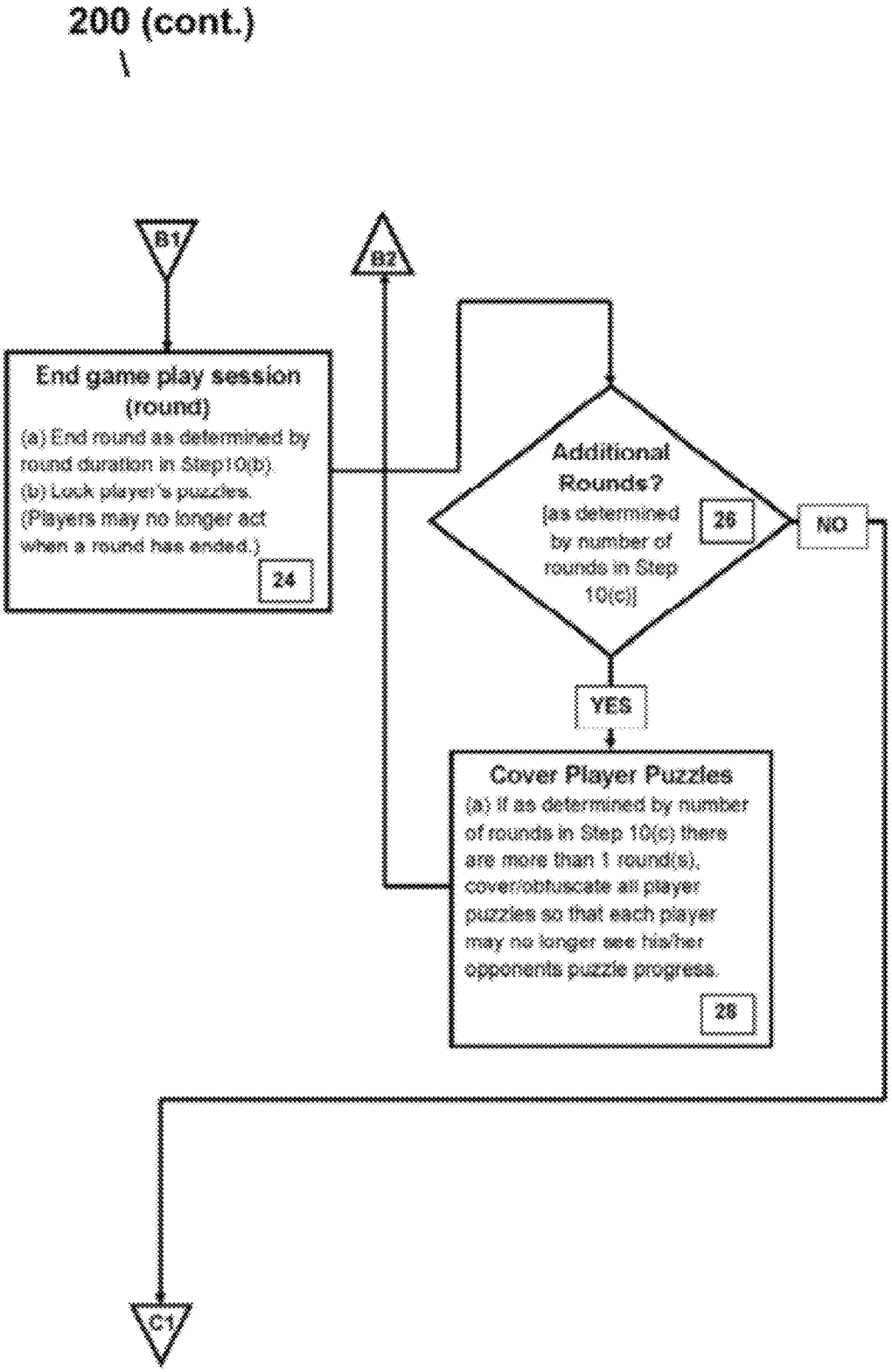
Figure 4D:
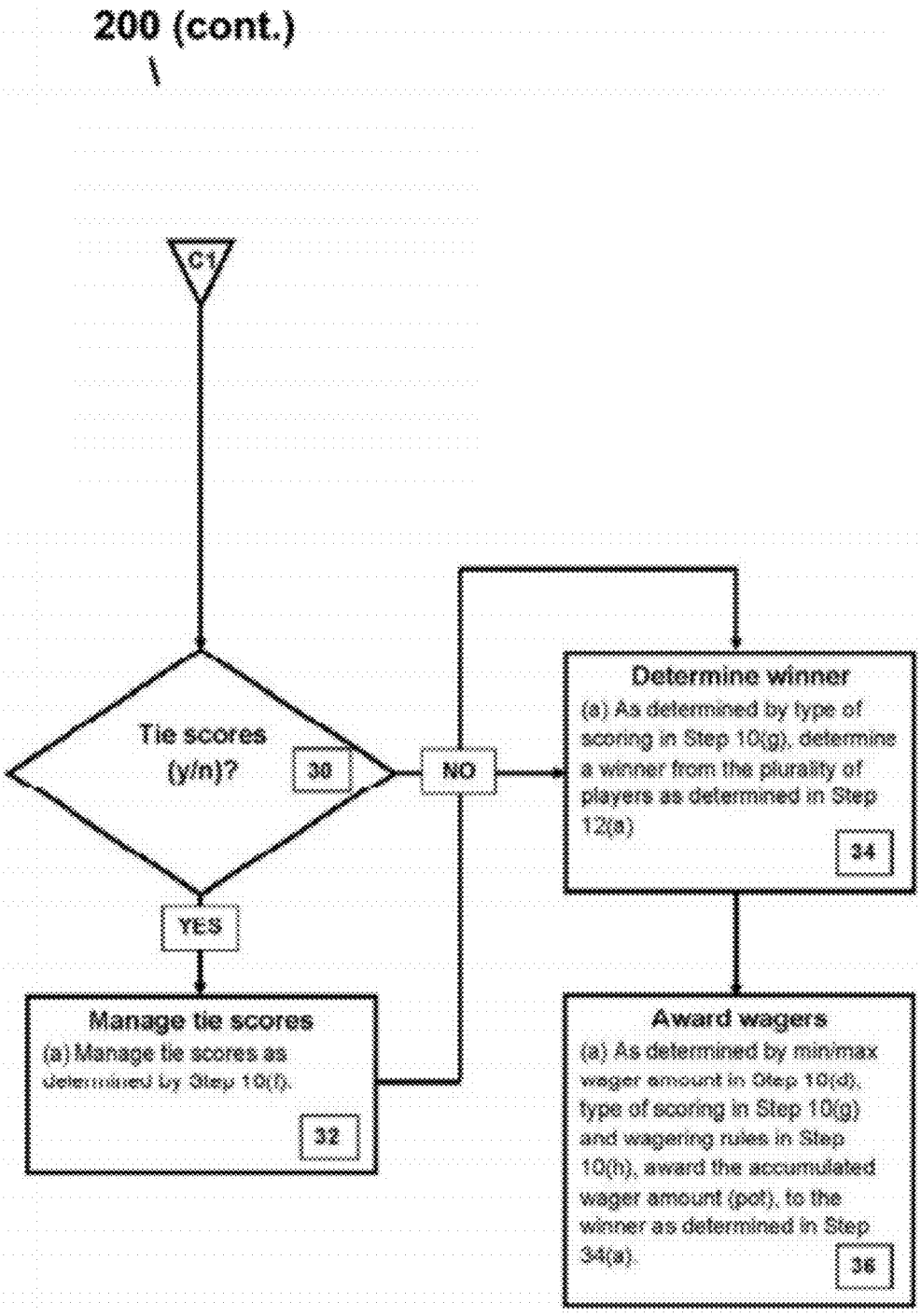

Referring now to FIGS. 3A-3C, a set of exemplary schematic diagrams illustrating process steps 10-36 representative of a first exemplary alternate embodiment of the inventive game method of FIG. 2, implemented as a PBW Game Method 100 utilizing "pattern recognition" type puzzle components and elements (e.g., such as Wordsearch puzzles, etc.)

Materials/game elements required: suitable writing instruments, writing surfaces (i.e., paper, preferably graph paper), a timer (e.g., a wristwatch, clock, stopwatch, sundial or any suitable timing device that allows one to calculate minutes and/or seconds), chips (e.g., poker chips, coins, cookies, or any suitable token representative of some predetermined value), and a dictionary (or any suitable/equivalent source of information).

Players: at least 3.

Pre-Game Preparation:

Preferably, each game comprises a predetermined set of gameplay rules that comprise pre-defined values, value ranges, and/or pre-selected options, for at least a portion of the pre-game preparation steps indicated below, so as to minimize the amount of time necessary to conduct the pre-game preparation process, or to eliminate it entirely by providing pre-defined selections for all of the pre-game preparation steps.

1) Determine the size of the puzzle grid to use, i.e., a 10×10 grid, a 12×12 grid, etc. Any size greater than 6×6 is acceptable. (This example will use a 12×12 grid.)
2) Designate a non-player as the "dealer".
3) Determine the amount of time allocated for each round of gameplay. (This example will use 45 seconds).
4) Determine the number of rounds in the game. (This example will use 3 rounds).
5) Determine a minimum wager amount (This example will use 1 chip).
6) Determine the number of words to search for (This example will use nine words).
7) Determine whether to split the pot wager between eligible players in the event of a tie, or continue to a tie-breaker.
8) Provide each player with an equal number of chips. (this example will use 25 chips).
9) Seat players around a table with the dealer also taking a position at the table. By way of example, the game-play may move clock-wise starting with the player seated to the dealer's left.

Dealer Preparation:

Preferably, the predetermined set of gameplay rules also that comprise pre-defined values, value ranges, pre-selected options, puzzles, and/or puzzle components and/or elements, for at least a portion of the pre-game preparation steps indicated below, so as to minimize the amount of time necessary to conduct the dealer preparation process, or to eliminate it entirely by providing pre-defined selections for all of the dealer preparation steps.

1) Select a piece of graph paper for each player and mark off an area equal the size of the agreed-upon grid on each piece of paper.
2) Select nine words from a dictionary, book, magazine or memory and write them down on an additional piece of paper. Place the piece of paper with the list of words in front of the game's players.
3) Out of view of the players, enter the nine words (see item 2 above), into the 12×12 grid for each player. There should be one grid/piece of graph paper for each player. Each grid requires all nine words. Words can be entered into each grid either forwards or backwards, i.e., the word CAT may be entered either as C A T, or as T A C. Generally, words can be entered in up to eight (8) directions:

a) horizontal, left to right. (forwards)
b) horizontal, right to left. (backwards)
c) vertical, top to bottom.
d) vertical, bottom to top.
e) diagonal, left to right, top to bottom.
f) diagonal, right to left, top to bottom.
g) diagonal, left to right, bottom to top.
h) diagonal, right to left, bottom to top.

Preferably, the same case (upper or lower) is used for each letter. Words may share letters (e.g., as in a crossword puzzle).

4) Fill in the remaining blank cells / squares in each player's puzzle using random letters, using the same case utilized for entering the words.

Gameplay:

Round 1 of 3:

a) Dealer collects an "ante" from each player. The ante equals the amount of the minimum wager agreed to in Pre-game Preparation (5) (or as dictated by the predetermined set of gameplay rules). These chips become the initial "pot".
b) Dealer passes each player a puzzle as described above. Puzzles remain face-up and visible to all players. Players may study their puzzles and the common list of words, but may not mark their puzzles in any way.
c) Wagering begins with the player to the dealer's left who may "check" (pass the wager to the next player), or wager (with additional chips). Each player must match the aggregate number of chips wagered until all player bets are equal. Each player after the first player to the left of the dealer may match the wager, raise the wager or fold (end his participation in the hand and give up the chips they have wagered). When the "action" comes full circle to the first player, the player must make up the difference between his original wager and any additional amounts wagered by other players, or may "raise" the wager. Wagering continues in this fashion until all bets are equal.
d) With wagering complete, the dealer sets the "timer" to the amount of time agreed on in Pre-game Preparation (3) (or as dictated by the predetermined set of gameplay rules). Players may then—preferably, but not necessarily, in full view of one another—begin to match the words on the common list, with the words in their individual puzzles. Words are marked as "found" by circling (or otherwise visually identifying them) in their horizontal, vertical, or diagonal positions.
e) When the timer runs out, the dealer asks the players to conceal their individual puzzles (for example, by each player placing their puzzle face-down in front of them), and the second round of wagering begins.

Round 2 of 3:

a) Wagering in Round 2 continues in the same manner as is described in item (c) of Round 1 of 3 above.
b) Wagering ends when all active player bets are equal. (as mentioned above, a player always has the right to "fold" and forfeit his wager. A player becomes inactive when they have folded).
c) With wagering complete, the dealer sets the "timer" to the amount of time agreed on in Pre-game Preparation (3) (or as dictated by the predetermined set of gameplay rules).
d) Players continue working on their individual puzzles as described in item (d), above. This time, however, and henceforth until the end of the game, players may elect to remove their individual puzzles from their competitions view. Alternately, predefined gameplay rules may enable (and/or require) that the dealer dictate if (and when) the players must remove their individual puzzles from their competitions view.
e) When the timer runs out, the dealer asks the players to conceal their individual puzzles (for example, by each player placing their puzzle face-down in front of them), and the third round of wagering begins.

Round 3 of 3:

a) Wagering in Round 3 continues in the same manner as is described in item (c) of Round 1 of 3, above.
b) Wagering ends when all active player bets are equal (as mentioned above a player always has the right to "fold" and forfeit his wager. A player becomes inactive when they have folded).
c) With wagering complete, the dealer sets the "timer" to the amount of time agreed on in Pre-game Preparation (3) (or as dictated by the predetermined set of gameplay rules).
d) Players continue working on their individual puzzles as described in item (d) of Round 1 of 3, above. Again, and henceforth until the end of the game, players may elect to remove their individual puzzles from their competitions view (or, as may be applicable, the predefined gameplay rules may require that each player's puzzle be concealed from other players).
e) When the timer runs out, the dealer asks the players to conceal their individual puzzles (for example, by each player placing their puzzle face-down in front of them), and the final round of wagering (i.e., the "showdown") begins.

Showdown:

1) At the "showdown", the final round of wagering, players may place their wagers, as described in item (c) of Round 1 of 3, above.
2) With wagering complete, all puzzles are turned face-up for the dealer to examine and score.
3) The pot is awarded to the player who has found the greatest number of words (i.e., to the player that has made the greatest progress toward solution of their puzzle(s)).
4) Game-play continues again from the beginning.
5) Game-play ends when one player has accumulated all of the chips.

Ties:

In the event of a tie (e.g., when two or more players have identified the same number of words), there are at least two options for resolution thereof:

1) Split the pot into equal portions amongst the players who are tied.
2) Initiate a pre-agreed on "tie-breaker" which can take any form from the toss of a coin to leaving the pot in place, and continuing with additional hands (i.e., additional gameplay rounds) amongst the tied players until the tie is broken.

Exemplary Embodiment #2:—Pattern Completion Game—Sudoku puzzle:

Referring now to FIGS. 4A-4D, a set of exemplary schematic diagrams illustrating process steps 10-36 representative of a first exemplary alternate embodiment of the inventive game method of FIG. 2, implemented as a PBW Game Method 200 utilizing "pattern completion" type puzzle components and elements (e.g., such as Sudoku puzzles, etc.)

Materials/game elements required: suitable writing instruments, writing surfaces (i.e., paper, preferably graph paper), a timer (e.g., a wristwatch, clock, stopwatch, sundial or any suitable timing device that allows one to calculate time in minutes and/or seconds), chips (e.g., poker chips, coins, cookies, or any suitable token representative of some predetermined value), and a pair of dice (or equivalent random number generators).

Players: at least 3.

Pre-Game Preparation:

Preferably, each game comprises a predetermined set of gameplay rules that comprise pre-defined values, value ranges, and/or pre-selected options, for at least a portion of the pre-game preparation steps indicated below, so as to minimize the amount of time necessary to conduct the pre-game preparation process, or to eliminate it entirely by providing pre-defined selections for all of the pre-game preparation steps.

1) Determine the "grid" size of the Sudoku puzzle to be used in the game, i.e., a 3×2 grid, a 3×3 grid, a 3×4 grid, etc. Any grid size greater than 3×1 is acceptable. (This example will use a size 3×2 grid puzzle). By way of example, a puzzle grid shown in FIG. 6A may be used.
2) Designate a non-player as the "dealer".
3) Determine the amount of time allocated for each round of gameplay. (This example will use 45 seconds).
4) Determine the number of rounds in the game. (This example will use 3 rounds).
5) Determine a minimum wager amount (This example will use 1 chip).
6) Determine the number of cells to allocate as pre-filled. (This example will use 9 cells).
7) Determine whether to split the pot between eligible players in the event of a tie, or to continue to a tie-breaker.
8) Determine and agree on a method of scoring (see exemplary scoring Method below, by way of example).
9) Provide each player with an equal number of chips. (This example will use 25 chips).
10) Seat players around a table with the dealer also taking a position at the table. By way of example, the gameplay may move clock-wise, starting with the player seated to the dealer's left.

Dealer Preparation:

Preferably, the predetermined set of gameplay rules also that comprise pre-defined values, value ranges, pre-selected options, puzzles, and/or puzzle components and/or elements, for at least a portion of the pre-game preparation steps indicated below, so as to minimize the amount of time necessary to conduct the dealer preparation process, or to eliminate it entirely by providing pre-defined selections for all of the dealer preparation steps.

Figure 5A:
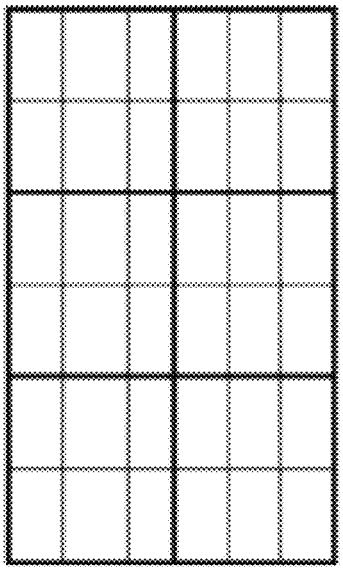
FIG. 5A shows an exemplary puzzle component layout that may be readily utilized, by way of example, in conjunction with the inventive game method embodiment of FIGS. 4A-4D.
Figure 5B:
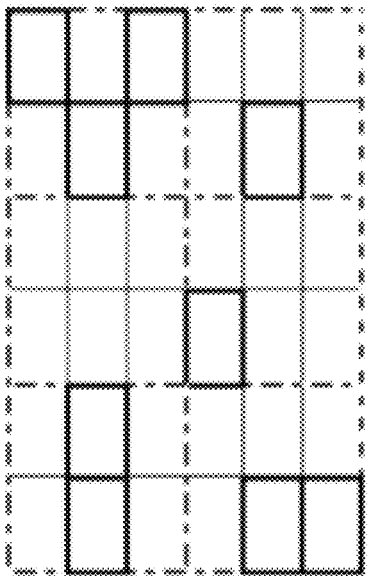
FIG. 5B shows an alternate exemplary puzzle component layout that may be readily utilized, by way of example, in conjunction with the inventive game method embodiment of FIGS. 4A-4D.

1) Select a piece of graph paper for each player and mark off an area equal the size of the agreed on Sudoku puzzle grid on each piece of paper.
2) Mark off nine cells on each puzzle at random positions in the puzzle. (The puzzle for each player may be different). Referring now to FIG. 5B, an alternate puzzle component configuration is shown, by way of example.

Scoring method example: In a 3×2 Sudoku puzzle each row, column and box must contain the numbers 1-6 only once. The sum of each row in a 3×2 will be 21. The sum of each column will also be 21. The total of all rows and columns will be (in this example) 256. Scoring (again, by way of this example only) is the responsibility of the dealer.

(a) The present example assumes that puzzles with no solution may be used. After the final round of wagering (the "showdown"), it is the dealer's responsibility to score each puzzle and determine a winner. If the dealer finds that the inherent rule of Sudoku is broken, he may "flip the sign" (i.e., cause the number to be negative) for any offending cells.

Figure 6A:
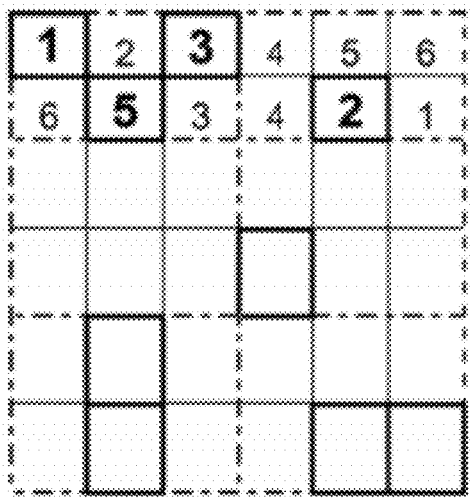
FIGS. 6A and 6B each show exemplary embodiments of pattern completion game puzzle solution scoring techniques usable in conjunction with implementation of the inventive game method embodiment of FIGS. 4A-4D.
Figure 6B:
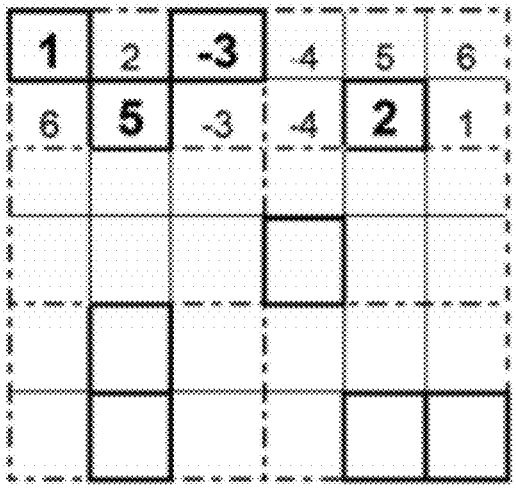
Figure 7A:
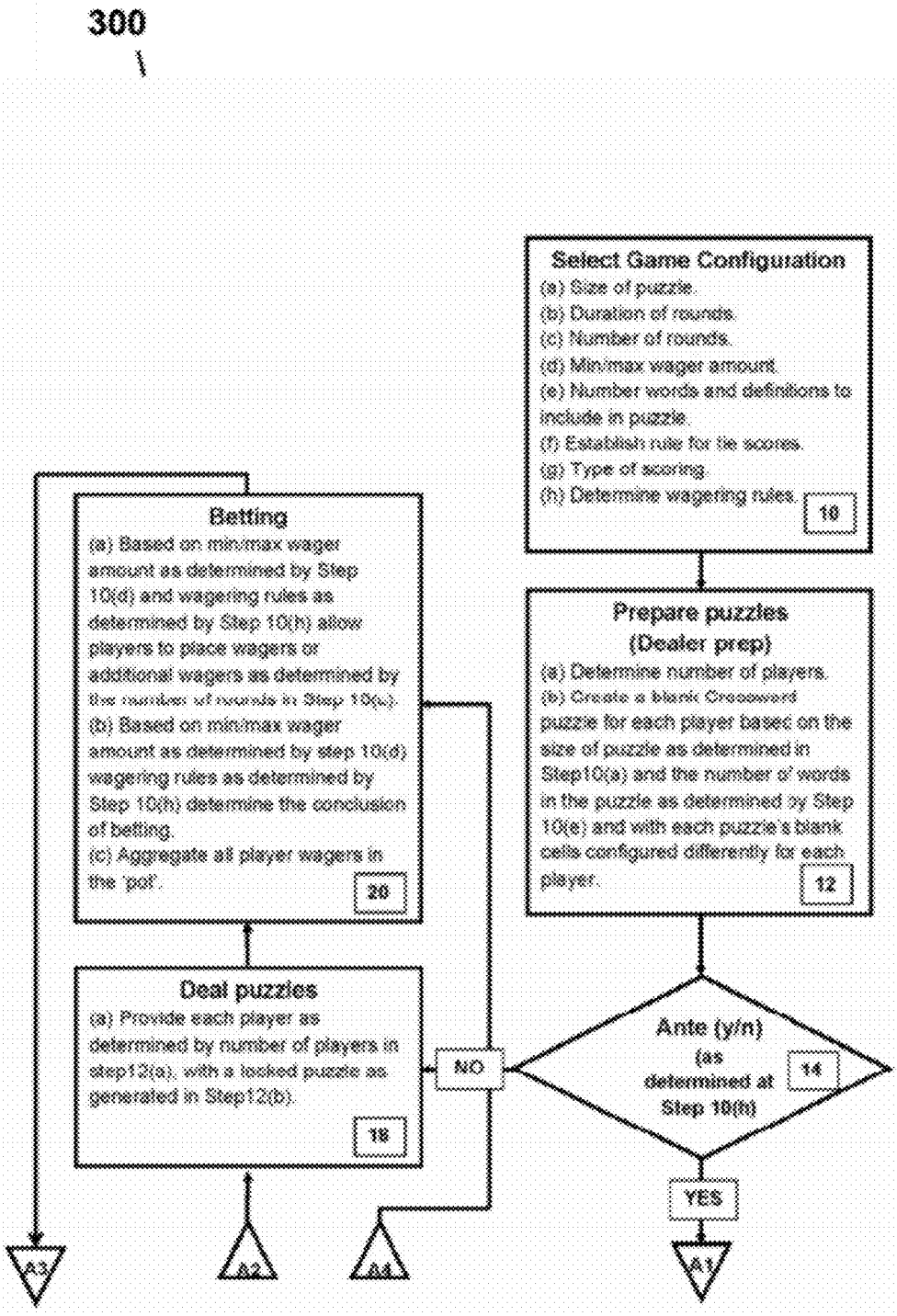
FIGS. 7A-7D are exemplary schematic diagrams illustrating process steps representative of a third exemplary alternate embodiment of the inventive game method of FIG. 2, implemented utilizing a "combination pattern recognition and pattern completion" type puzzle components and elements.
Figure 7B:
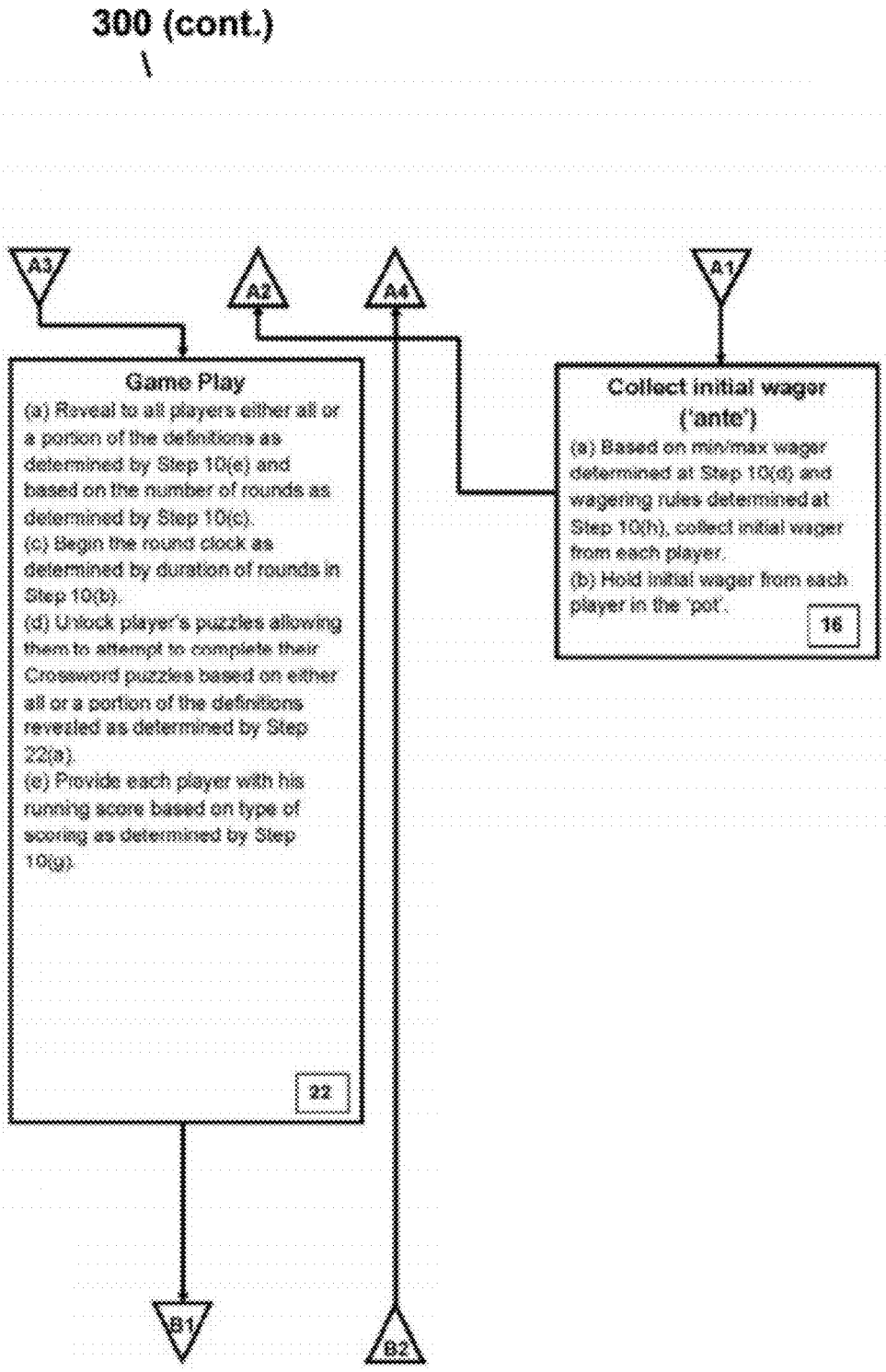
Figure 7C:
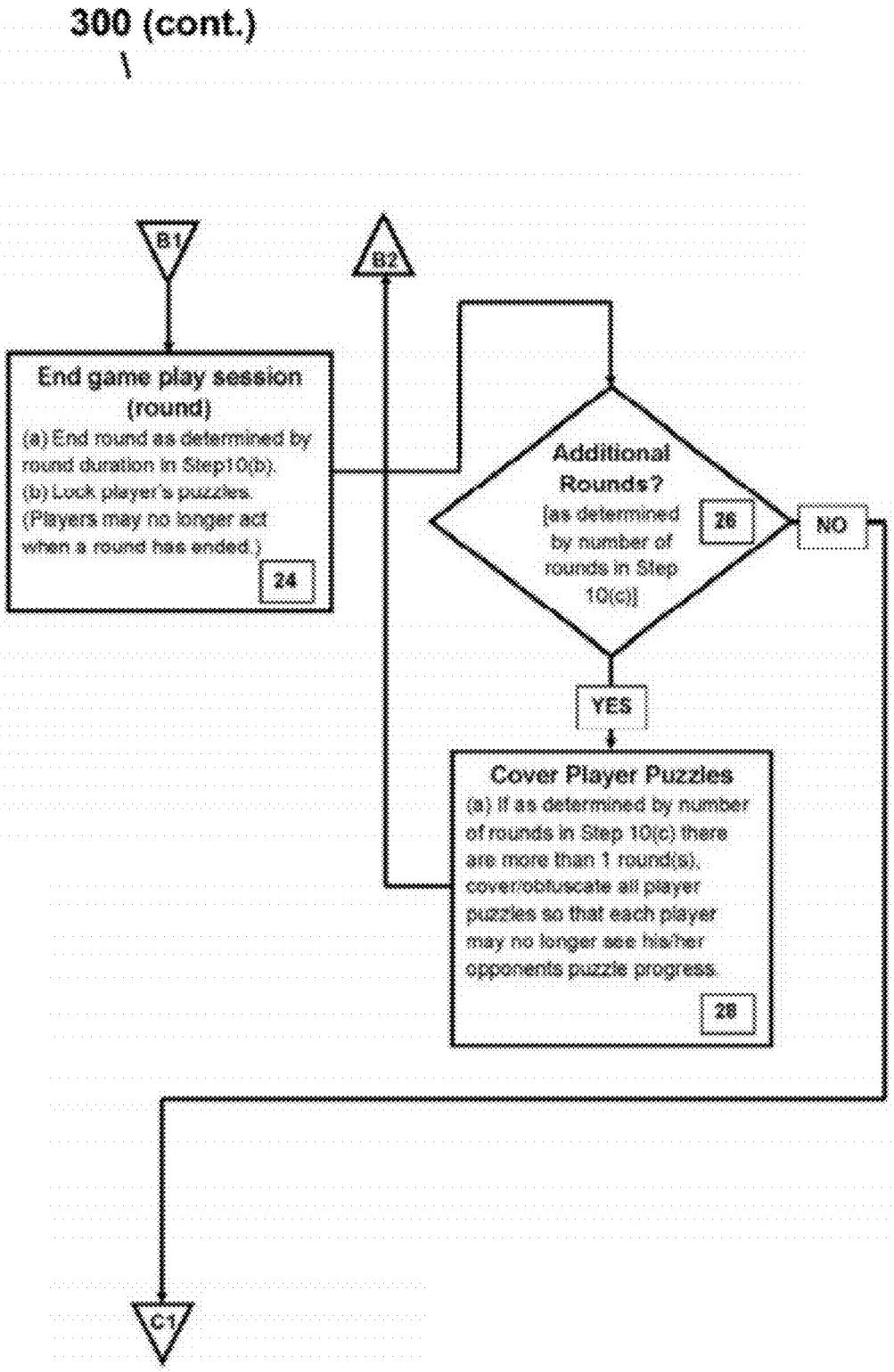
Figure 7D:
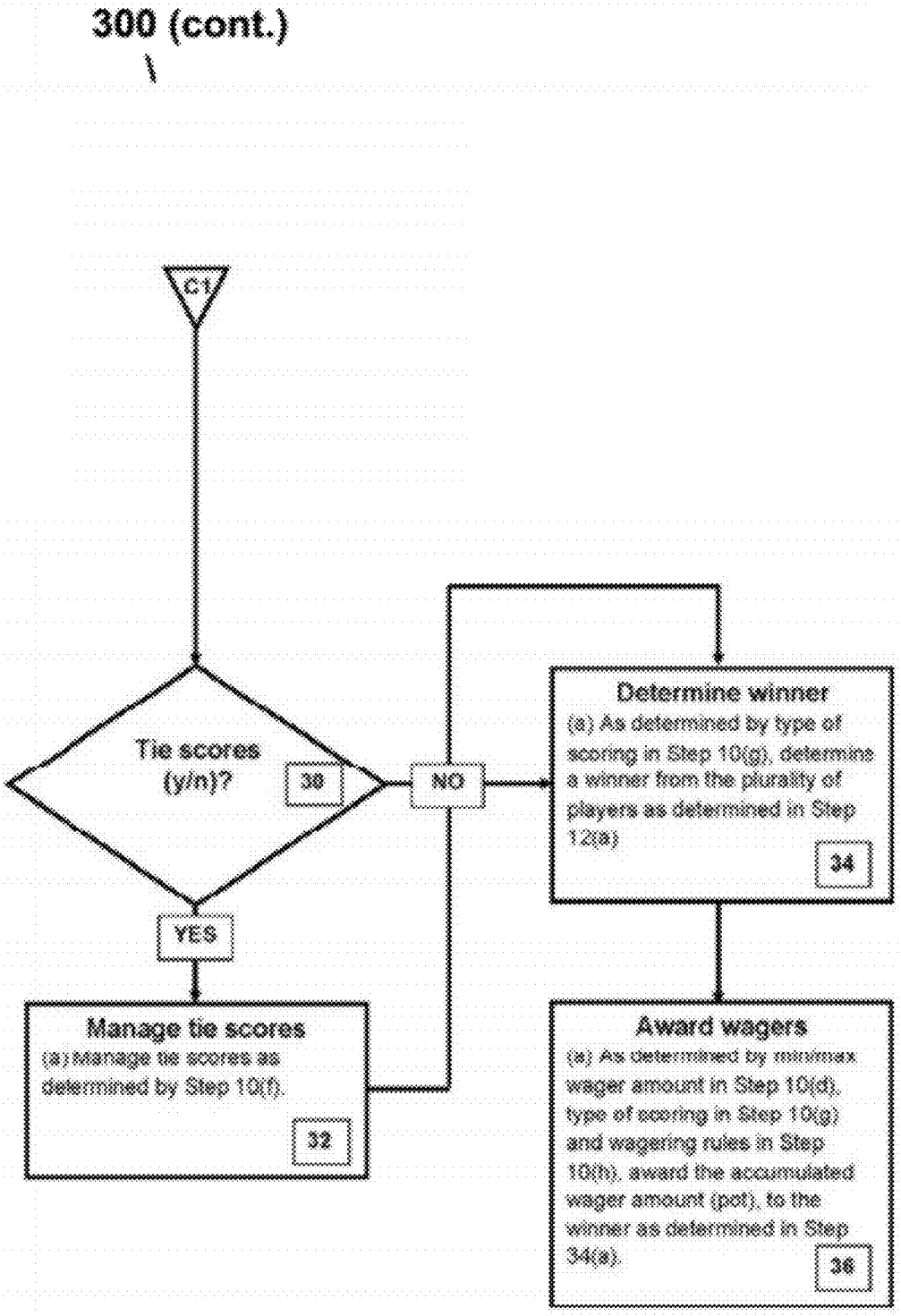
Figure 8A:
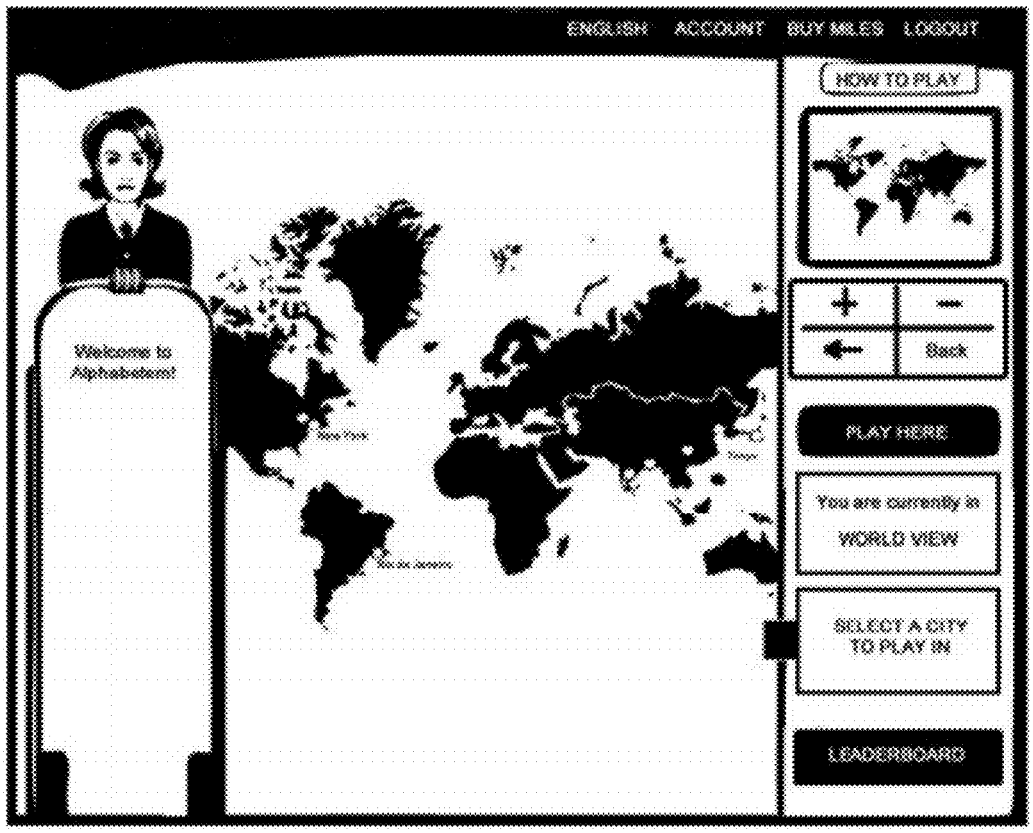
FIGS. 8A-8F show various aspects and views of exemplary graphical user-interface implementations that may be advantageously provided for various exemplary embodiments of a novel game environment that may be used in conjunction with the inventive system of FIG. 1, the inventive game method of FIG. 2, with the inventive game methods of FIGS. 2, 3A-3C, 4A-4D, and 7A-7D, above, and with other exemplary embodiments of the present invention, in which the inventive user-accessible game environment may be represented in a geographic map format, having various selectable gameplay site regions, as well as additional user-interface game components and controls, with exemplary gameplay sites in each region being indicated by user-selectable markers, enabling users to browse available gameplay sites, and, when a desired gameplay site is selected, to participate in one or more games offered therein.
Figure 8B:
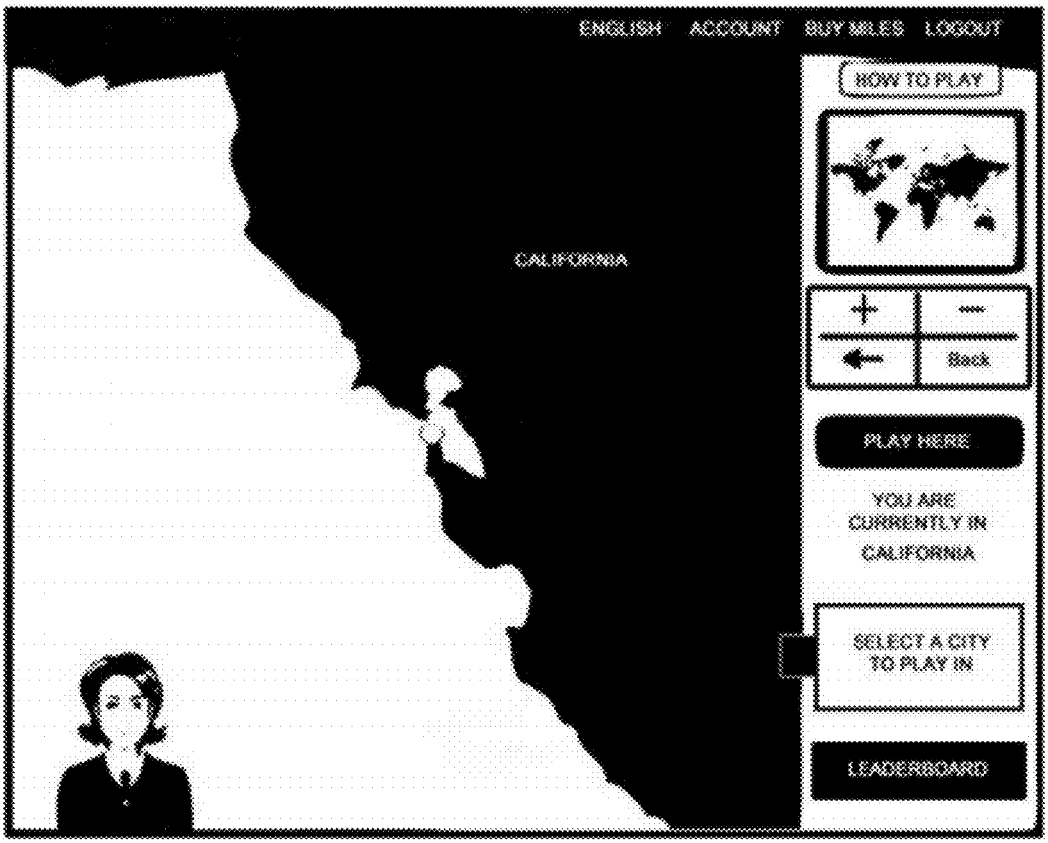
Figure 8C:
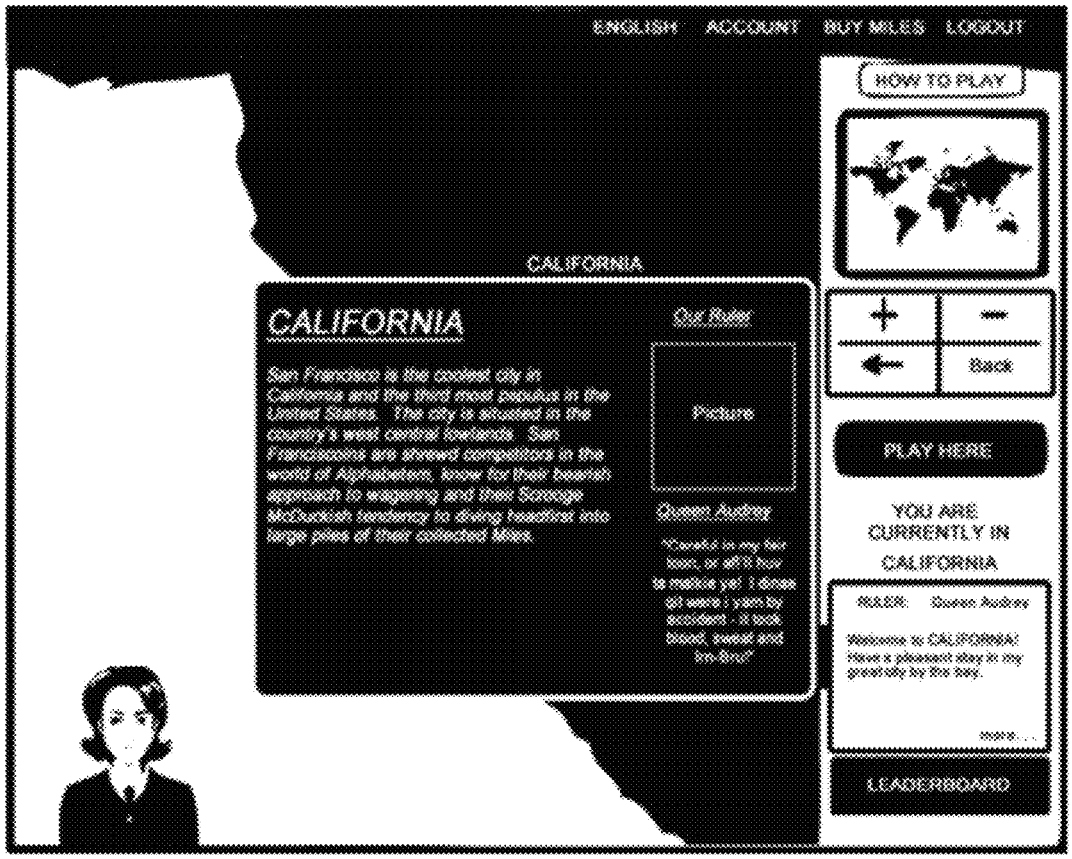
Figure 8D:
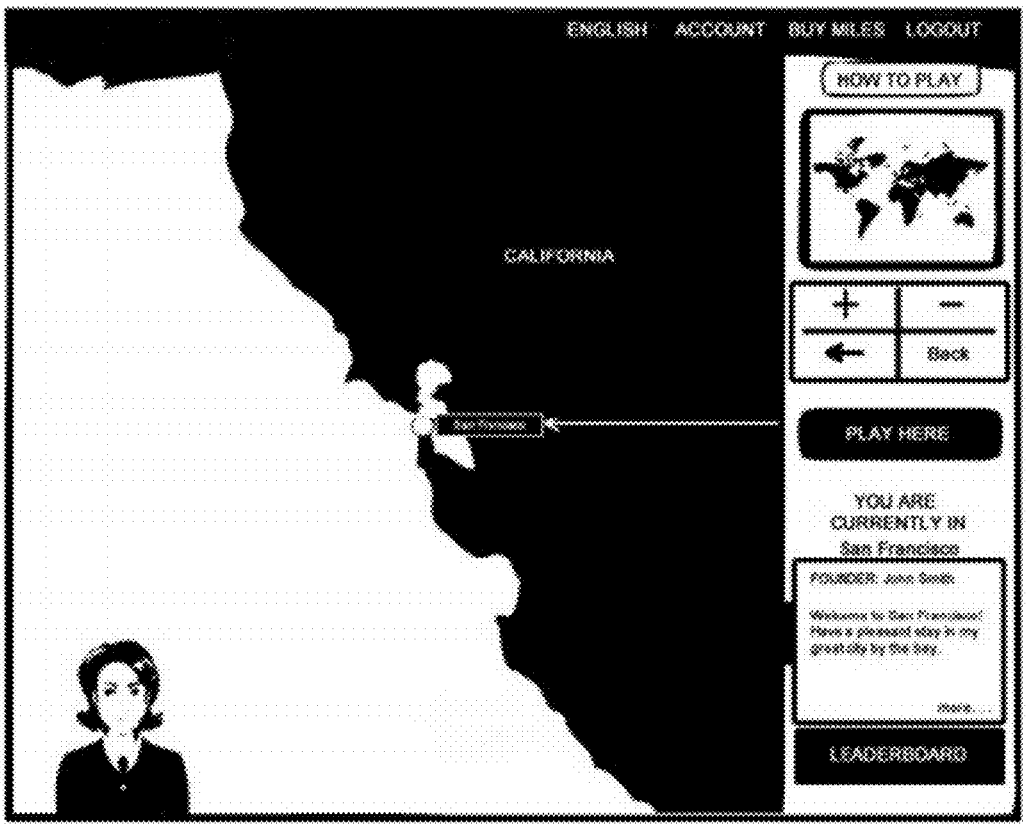
Figure 8E:
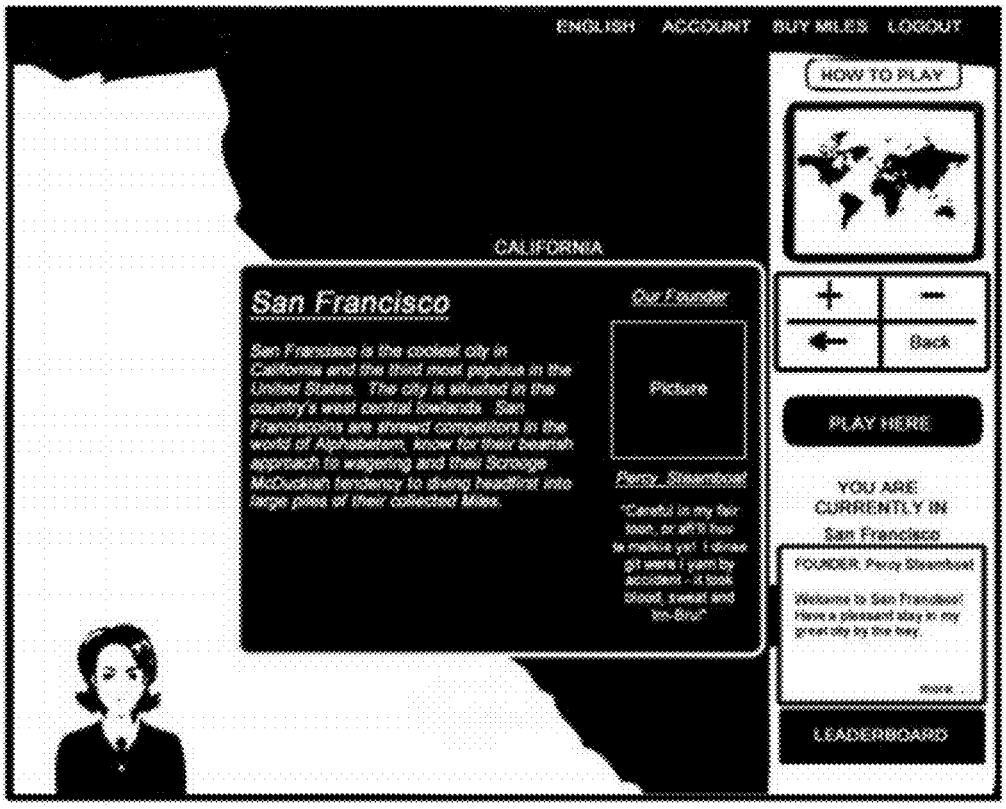
Figure 8F:
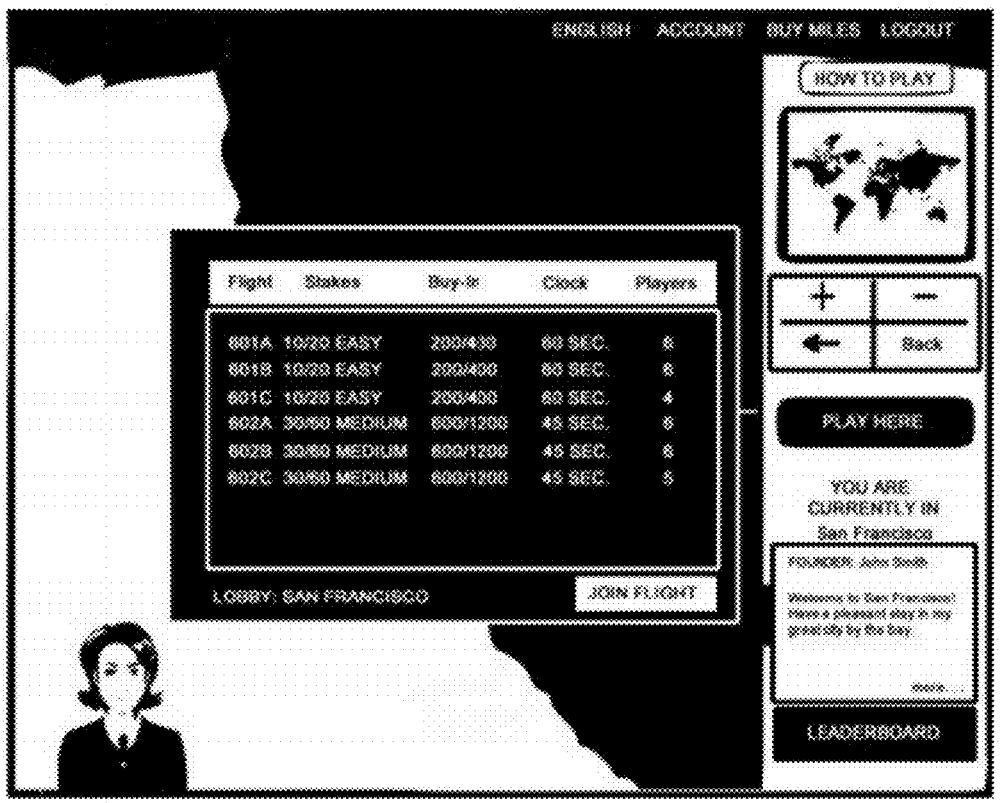

(b) Referring now to FIGS. 6A and 6B (in both of which larger font size entries indicate numbers supplied by the dealer), based on the above, the entries shown in a puzzle component 290A in FIG. 6A, become the entries shown in puzzle component 295B in FIG. 6B.

The score for row 1 is then: 7 (the sum of 1+3+−3+−4+5+6).

The score for row 2 is then: 7 (the sum of 6+5+−3=−4+2+1).

The score for column 1 is: 7

The score for column 2 is: 7

The score for column 3 is −6

The score for column 4 is: −8

The score for column 5 is: 7

The score for column 6 is: 7

Accordingly, the score for this exemplary puzzle is: 28

Gameplay:

Round 1 of 3:

a) Dealer collects an "ante" from each player. The ante equals the amount of the minimum wager agreed to in Pre-game Preparation (5) (or as dictated by the predetermined set of gameplay rules). These chips comprise the initial "pot".
b) Dealer passes each player a puzzle as described above. Puzzles remain face up and visible to all players. Players may study their puzzles but may not mark their puzzles in any way.
c) Wagering begins with the player to the dealer's left who may "check" (pass the wager to the next player) or wager additional chips. Each player must match the aggregate number of chips wagered until all player bets are equal. Each player after the first player to the left of the dealer may match the wager, raise the wager or fold (end his participation in the hand and give up the chips they have wagered). When the "action" comes full circle to the first player, the player must make up the difference between his original wager and any additional amounts wagered by other players, or may "raise" the wager. Wagering continues in this fashion until all bets are equal.
d) With wagering complete, the dealer rolls the die (in this example, 1 die is used. The maximum value allowed in a 3×2 grid Sudoku puzzle is 6), and then enters the number shown by the die into any marked cell (see Dealer Preparation (2) above) on each player's puzzle. The dealer repeats this process several times (e.g., 4 times) until each player puzzle has 4 numbers filled in. Each player's puzzle will then have the same 4 numbers, but in different positions.
e) With preparation complete, the dealer sets the "timer" to the amount of time agreed on in Pre-game Preparation (3) (or as dictated by the predetermined set of gameplay rules). Players may then—in full view of one another—begin to complete the remaining cells of their puzzle. Players are not allowed to fill in cells marked by the dealer. Players are allowed to "erase".
f) When the timer runs out, the dealer asks the players to conceal their individual puzzles (for example, by each player placing their puzzle face-down in front of them), and the second round of wagering begins.

Round 2 of 3:

a) Wagering in Round 2 continues in the same manner as is described in item (c) of Round 1 of 3, above.

b) Wagering ends when all active player bets are equal. (as mentioned above a player always has the right to "fold" and forfeit his wager. A player becomes inactive when they have folded).

c) With wagering complete, the dealer rolls the die then enters the number shown by the die into any empty dealer-marked cell on each player's puzzle. The dealer repeats this process 3 times, until each player's puzzle now has a total of 7 numbers filled-in. Each player's puzzle will then have the same 7 numbers, but in different positions.

d) With preparation complete, the dealer sets the "timer" to the amount of time agreed-upon in Pre-game Preparation (3) (or as dictated by the predetermined set of gameplay rules). Players may then begin to complete the remaining cells of their puzzle. Players are not allowed to fill in cells marked by the dealer. Players are allowed to "erase". This time, however, and henceforth until the end of the game, players may elect to remove their individual puzzles from their competitions view. Alternately, predefined gameplay rules may enable (and/or require) that the dealer dictate if (and when) the players must remove their individual puzzles from their competitions view.

e) When the timer runs out, the dealer asks the players to conceal their individual puzzles (for example, by each player placing their puzzle face-down in front of them), and the third round of wagering begins.

Round 3 of 3:

a) Wagering in Round 3 continues in the same manner as is described in item (c) of Round 1 of 3, above.

b) Wagering ends when all active player bets are equal. (As is mentioned above, a player always has the right to "fold" and forfeit his wager. A player becomes inactive when they have folded).

c) With wagering complete, the dealer rolls the die then enters the number shown by the die into any empty dealer-marked cell on each player's puzzle. The dealer repeats this process two times until each player puzzle now has a total of 9 numbers filled in. Each player's puzzle will then have the same 9 numbers, but in different positions.

d) With preparation complete, the dealer sets the "timer" to the amount of time agreed-upon in Pre-game Preparation (3) (or as dictated by the predetermined set of gameplay rules), for the final time. Players may then begin to complete the remaining cells of their puzzle. Players are not allowed to fill in cells marked by the dealer. Players are allowed to "erase". As in Round 2, players may elect to remove their individual puzzles from their competitions view (or, as may be applicable, the predefined gameplay rules may require that each player's puzzle be concealed from other players).

e) When the timer runs out, the dealer asks the players to conceal their individual puzzles (for example, by each player placing their puzzle face-down in front of them), and the final round of wagering (i.e., the "showdown") begins.

Showdown:

1) At the "showdown", the final round of wagering, players may place their wagers, as described in item (c) of Round 1 of 3, above.

2) With wagering complete all puzzles are turned face-up for the dealer to score. Scoring may take the form suggested above, or any form pre-arranged by players, or is preferably dictated by the predetermined set of gameplay rules.

3) Once the dealer declares a winner, the pot is awarded thereto.

4) Game-play continues again from the beginning.

5) Game-play ends when one player has accumulated all of the chips.

Ties:

In the event of a tie (two or more players have the same final score), there are at least two options for resolution thereof:

a) Split the pot into equal portions amongst the players who are tied.

b) Initiate a pre-agreed on "tie-breaker" which can take any form from the toss of a coin to leaving the pot in-place and continuing with additional hands (i.e., additional gameplay rounds) amongst the tied players until the tie is broken.

Exemplary Embodiment #3: Pattern Matching Game/Pattern Completion Crossword Puzzle Referring now to FIGS. 7A-7D, a set of exemplary schematic diagrams illustrating process steps 10-36 representative of a first exemplary alternate embodiment of the inventive game method of FIG. 2, implemented as a PBW Game Method 200 utilizing "combination pattern completion and pattern recognition" type puzzle components and elements (e.g., such as Crossword puzzles, etc.)

Materials/game elements required: suitable writing instruments, writing surfaces (i.e., paper, preferably graph paper), a timer (e.g., a wristwatch, clock, stopwatch, sundial or any suitable timing device that allows one to calculate minutes and/or seconds), chips (e.g., poker chips, coins, cookies, or any suitable token representative of some predetermined value), and a dictionary (or any suitable/equivalent source of information).

Players: at least 3.

Pre-game Preparation:

Preferably, each game comprises a predetermined set of gameplay rules that comprise pre-defined values, value ranges, and/or pre-selected options, for at least a portion of the pre-game preparation steps indicated below, so as to minimize the amount of time necessary to conduct the pre-game preparation process, or to eliminate it entirely by providing pre-defined selections for all of the pre-game preparation steps.

1) Designate a non-player as the "dealer".

2) Determine the amount of time allocated for each round of gameplay. (This example will use 90 seconds).

3) Determine the number of rounds in the game. (This example will use 3 rounds).

4) Determine a minimum wager amount (This example will use 1 chip).

5) Determine the number of words to include in the puzzle. (This example will use nine words).

6) Determine whether to split the pot between eligible players in the event of a tie, or continue to a tie-breaker.

7) Determine and agree on a method of scoring (see tip below).

8) Provide each player with an equal number of chips. (this example will use 25 chips).

9) Seat players around a table with the dealer also taking a position at the table: By way of example, the game-play may move clock-wise starting with the player seated to the dealer's left.

Dealer Preparation:

Preferably, the predetermined set of gameplay rules also that comprise pre-defined values, value ranges, pre-selected options, puzzles, and/or puzzle components and/or elements, for at least a portion of the pre-game preparation steps indicated below, so as to minimize the amount of time necessary to conduct the dealer preparation process, or to eliminate it entirely by providing pre-defined selections for all of the dealer preparation steps.

1) Dealer selects nine words and definitions from a dictionary
2) Dealer records the nine definitions and words on a worksheet (or equivalent), keeping this information out of view of the players at the table.
3) Dealer marks off a blank crossword puzzle for each player on separate pieces of graph paper.

Gameplay:

Round 1 of 3:

a) Dealer collects an "ante" from each player. The ante equals the amount of the minimum wager agreed to in Pre-game preparation (4) (or as dictated by the predetermined set of gameplay rules). These chips become the initial "pot".
b) Dealer passes each player a blank crossword puzzle as described above. Puzzles remain face up and visible to all players. Players may study their puzzles, but may not mark their puzzles in any way.
c) Dealer reveals 4 of the 9 definitions allowing players to jot them down on their respective sheets of graph paper.
d) Wagering begins with the player to the dealer's left who may "check" (pass the wager to the next player), or wager additional chips. Each player must match the aggregate number of chips wagered until all player bets are equal. Each player after the first player to the left of the dealer may match the wager, raise the wager or fold (end his participation in the hand and give up the chips they have wagered). When the "action" comes full circle to the first player, the player must make up the difference between his original wager and any additional amounts wagered by other players, or may "raise" the wager. Wagering continues in this fashion until all bets are equal.
e) With wagering complete, the dealer sets the "timer" to the amount of time agreed-upon in Pre-game Preparation (2) (or as dictated by the predetermined set of gameplay rules). Players may then—preferably, but not necessarily, in full view of one another—begin to complete their puzzles based on the 4 definitions they have received from the dealer. Players are allowed to "erase".
f) When the timer runs out, the dealer asks the players to conceal their individual puzzles (for example, by each player placing their puzzle face-down in front of them), and the second round of wagering begins.

Round 2 of 3:

a) Wagering in Round 2 continues as described in item (d) of Round 1 of 3, above.
b) Wagering ends when all active player bets are equal. (as mentioned above, a player always has the right to "fold" and forfeit his wager. A player becomes inactive when they have folded).
c) With wagering complete, the dealer reveals 3 additional definitions, allowing players to write them down.
d) With preparation complete, the dealer sets the "timer" to the amount of time agreed-upon in Pre-game Preparation (3) (or as dictated by the predetermined set of gameplay rules). Players may then continue to work on their puzzle. Players are allowed to "erase". This time, however, and henceforth until the end of the game, players may elect to remove their individual puzzles from their competitor's view. Alternately, predefined gameplay rules may enable (and/or require) that the dealer dictate if (and when) the players must remove their individual puzzles from their competitions view.
e) When the timer runs out, the dealer asks the players to conceal their individual puzzles (for example, by each player placing their puzzle face-down in front of them), and the third round of wagering begins.

Round 3 of 3:

a) Wagering in Round 3 continues as described in item (d) of Round 1 of 3, above.
b) Wagering ends when all active player bets are equal. (as mentioned above a player always has the right to "fold" and forfeit his wager. A player becomes inactive when they have folded).
c) With wagering complete, the dealer reveals the final 2 definitions, allowing players to write them down.
d) With preparation complete, the dealer sets the "timer" to the amount of time agreed-upon in Pre-game Preparation (2) (or as dictated by the predetermined set of gameplay rules), for the final time. Players may then begin to complete the remaining cells of their puzzle. Players are allowed to "erase". As in Round 2, players may elect to remove their individual puzzles from their competitor's view (or, as may be applicable, the predefined gameplay rules may require that each player's puzzle be concealed from other players).
e) When the timer runs out, the dealer asks the players to conceal their individual puzzles (for example, by each player placing their puzzle face-down in front of them), and the final round of wagering (i.e., a "showdown") begins.

Showdown:

1) At the "showdown", the final round of wagering, players may place their wagers, as described in item (d) of Round 1 of 3, above.
2) With the wagering complete, all puzzles are turned face-up for the dealer to score. Scoring may take any form pre-arranged by players, or is preferably dictated by the predetermined set of gameplay rules.
3) The dealer declares a winner and awards the pot thereto.
4) Game-play continues again from the beginning.
5) Game-play ends when one player has accumulated all of the chips.

The system and method of the present invention, in various additional exemplary embodiments thereof, also address other flaws and disadvantages of previously known gaming solutions, by enabling provision and management of a multi-platform capable online game environment and related infrastructure that may be readily adapted and configured for advantageous utilization and implementation therein of different multi-player online games, in which the very processes of selection by players of particular virtual gameplay sites for entry into, and participation in, one or more games offered therein, are seamlessly incorporated into the game environment and infrastructure as integral aspects of overall "gaming experience", essentially offering players a separate layer of gameplay experiences in the utilization thereof.

In summary, the additional exemplary embodiments of the present invention, are directed to a system and method that enable provision and management of a dynamic online game environment and related infrastructure, that may be readily adapted and configured for advantageous utilization and implementation in conjunction with deployment therein of plural multi-player online games having at least social interaction and competitive aspects, and incorporating utilization of virtual in-game currency, where in various inventive embodiments of the provided game environment/infrastructure, the processes of player selection of particular virtual gameplay sites for entry into, and participation in, one or more games offered therein, as well as user-centric gameplay site organization and management features, are seamlessly incorporated into the game environment and infrastructure as integral aspects of overall "gaming experience".

Furthermore, the inventive system and method also offer additional layers of strategic, social, and business-based gaming experiences to interested users that are synergistic with, but that may be enjoyed separately from, the offered games themselves, thus complementing and greatly improving user enjoyment of various offered games and enhancing the user experience. This novel approach also offers multiple types of player hierarchies and corresponding advancement paths, such as:

(1) social/business centric paths for players interested in increasing their social status in the overall game environment, and/or in maximizing their ability to generate and acquire virtual game currency (e.g., by acquiring, developing, promoting, and growing multiple successful gameplay sites offering various games to other players), and/or (2) gameplay achievement paths for players interested in achieving rewards (e.g., in-game renown, acquisition of virtual game currency) through successes in competitive gameplay and advancement in game rankings (optionally with the players earning "titles" such as a "King" or "Queen" of a predefined game region that can bring them in-game virtual currency earnings and that optionally they need to defend on a continuous basis).

Advantageously, the additional exemplary embodiments of the inventive system and method, may be readily implemented with virtually any type of online game that is based on small groups of players engaging in competitive game sessions, whether conventional or casual gaming—style online poker games, or preferably with puzzle-based wagering games ("PBW Games"), such as described above, for example, based on utilization of Sudoku, Wordsearch, and/or Crossword puzzle components.

Prior to describing various additional exemplary embodiments of the present invention, comprising novel PBW Game Environments in greater detail, it should be noted that particular game environments and related features (such as world or regional maps, and corresponding cities, etc. as shown by way of illustrative examples in FIGS. 8A-8F hereto) are referred to by way of example only, and can be readily substituted with any equivalents thereof, such as galactic regions, solar systems, and planets.

In at least one illustrative additional exemplary embodiment of the present invention configured for use in conjunction with PBW Games, rather than displaying, to prospective players, a filterable list of "PBW Games tables" to play at, the inventive gameplay environment, will present the prospective players with an interactive world map. On this map, cities will be represented in two ways:

1) Via a Label (i.e., the name of the city), and

2) Via a Marker (i.e., a symbol or other graphic), indicating cities where game-play is available.

Markers may be displayed in one or more of a set of different possible states, for example represented by different colors:

Color-1—all tables in the city are full,

Color-2—no tables in the city are active (but available, i.e., all tables are empty), Color-3—some tables in the city are active but there is room to take a seat and play.

Cities represented on the map are be segregated into "regions". For example, Houston and Dallas are part of Texas. Delhi and Agra (India) are part of Utter Pradesh. Cities represented on the map may either be "enabled" (i.e., comprising a Marker) or "not enabled" (i.e., lacking a Marker). When selected, each enabled city will present the player with a list of game tables available in that particular city. This list may be presented in tabular form, and would be far shorter than one list for all game tables. The list could also present a representative selection of various versions of the PBW Game(s), in addition to a practice table where users can play against the clock.

Advantageously, in various additional exemplary embodiments thereof, the inventive system and method may comprise at least a portion of the following novel features:

"Raking":—One or more turns (e.g., "hands") in every game played (tournaments excepted) in the inventive gameplay environment framework will be "raked". This means that a percentage of each pot is taken back by the "house".

Multiple Types of Player Hierarchies & Corresponding Advancement Paths: Social/Business—centric as well as Gameplay—centric with each type being suited for a particular style/preferences of play, for example, such as relying on the degree of players' interest in exploring/participating in various infrastructure (e.g., social, business, organizational, etc.) aspects of the PBW Game Environment, in addition to, or even instead of, playing the games themselves.

Social/Business—Based Player Hierarchy/Advancement: The goal in all "play-for-fun" social networking games is to attrite a player's virtual goods. This means that while it costs a player nothing to begin playing the game (a player is given a certain amount of virtual currency to start), over time the player will need additional virtual currency or goods to continue to play and enhance their gameplay experience. The player needs to either, win this currency, purchase it directly, or gain it by participating in some sort of offer.

Integrating the process of gameplay table selection into the infrastructure of the game(s), rather than treating it merely as a "necessary evil" step that must be completed as a pre-requisite to gameplay, adds a fourth means of gaining additional virtual currency. As noted above, cities will either be active or inactive (i.e., each city will either comprise, or lack, a Marker). Optionally, in accordance with at least a portion of the additional exemplary embodiments of the present invention, players may be permitted to lease and/or to purchase dormant cities with their virtual currency, thereby making them active. A player that chooses to participate in this aspect of the novel PBW Game Environment will be designated as FOUNDER of the city that they enable. As a FOUNDER of a city, a player will receive a portion of the rake generated by that city. Being designated as a FOUNDER will of course also require that the player spend virtual currency (i.e., that they make an investment) for the privilege of such ownership. FOUNDERs may be listed in the town/cities "lobby"/gameplay entry areas, and/or announced by the PBW Game Environment's avatar host or hostess. A FOUNDER will be incentivized to bring their friends to play in their city, through their right to receive a percentage of the rake their friends' gameplay in their city will generate.

Ownership of player-founded cities would preferably also revert back to the business entity that operates/owns the PBW Game Environment ("Owner Entity"), should predetermined minimum gameplay activity benchmarks are not met by certain cities. In other words, if a player founded a city and no one plays in it for a predefined period of time, and/or if no reasonable player activity is observed in that city, the ownership of the city reverts back to the Owner Entity.

As each city may start with a pre-set number of representative gameplay "tables" defined therein—a successful FOUNDER would inevitably want to add additional tables/games to their city to handle the player traffic attracted/pushed to that city (thereby increasing their take of the corresponding generated rake). The option of being able to define/add new gameplay tables/game types, may be permitted to the FOUNDER by the Owner Entity for additional predetermined charges. FOUNDERs may also be permitted to spend virtual currency on in-game, game-wide advertising to attract additional players to their city. FOUNDERs may also be provided with the ability to "sell' their city to other players.

"Gameplay"—Based Player Hierarchy/Advancement:

In addition to the notion of FOUNDERs, in at least one exemplary embodiment thereof, the inventive system and method may be operable to rank players by region (e.g., by a US state, by an Indian province, etc.) on a monthly (or other periodic) basis. At the end of each calendar month (or period) the PBW Game Environment may "crown" a King (or Queen) of each region, determined by a suitable formula (e.g., for example, weighted toward the number of "games won", rather than a total amount of virtual currency won (optionally, there may be some weight attributed to virtual currency, and/or players may be allowed to purchase "games won points" with virtual currency—to increase their number of "games won").

Similarly to a FOUNDER, the King or Queen of a region may also share in rake generated by that region, the difference being that the inventive system and method may be operable to change Kings and Queens on a periodic (e.g., a monthly) basis (e.g., King-ship may be a more tenuous position than that of a FOUNDER), while FOUNDERs need only maintain an appropriate minimum level of gameplay/player activity in their particular city. Kings and Queens may draw a percentage of rake from (potentially) many cities, while FOUNDERs would draw a percentage of rake only from the individual cities that they have founded.

Referring now to FIGS. 8A-8F, various aspects and views 400-650, respectively, of exemplary graphical user interface implementations that may be advantageously provided for various exemplary embodiments of a novel PBW Game Environment that may be used in conjunction with the inventive system 10 of FIG. 1, the inventive game methods of FIGS. 2, 3A-3C, 4A-4D, and 7A-7D, and with other exemplary embodiments of the present invention, in which the inventive user-accessible PBW Game Environment may be represented in a geographic map format, having various selectable gameplay site regions, as well as additional user-interface game components and controls, with exemplary gameplay sites in each region being indicated by user-selectable markers, enabling users to browse available gameplay sites, and, when a desired gameplay site is selected, to participate in one or more games offered therein.

In at least one alternate embodiment of the present invention, the PBW Game Environment may be advantageously deployed to implement one or more competitive language skill development and learning tools in various educational system contexts. For example lower school grades can use various appropriately configured word-related PBW games to develop spelling and "sight words" skills, while middle and upper school grades can utilize one or more appropriately configured PBW Game Environments as local (e.g., English) and/or foreign (e.g., Spanish) language facilitator for in-class learning, as homework, or as part of extra credit schoolwork. Depending on the type of PBW Games configured in the educational PBW Game Environments, additional skills and subjects other than language could be covered such as mathematics and logic skills.

Advantageously, the educational PBW Game Environments are readily scalable and may be utilized to provide competitive educational gameplay on every desired level, with all of the above PBW Gameplay being readily implemented online in a geographically independent manner:

(1) From determining the best student in a particular language at a variety of competitive tiers through:
  (a) student to student play within a particular class
  (b) student to student play within a school
  (c) student to student play within a school district, (and further scalable to play within a city, state, country, continent and worldwide)

(2) To determining the best class and/or school in a particular language at a variety of competitive tiers through staged tournament play (for example in a manner similar to that used in spelling competitions, debate completions and the like.

To add an additional level of engagement, the educational PBW Game Environments may also include an adapted gameplay path infrastructure (e.g. such as having equivalents of FOUNDERS, Kings and Queens, etc. in an educational context (such as Champion of the School, of the City, etc.).

Deployment of various inventive embodiments of the PBW Game Environments in the educational context as described above, would add a new dimension to school work, make language-related learning much more interesting and engaging, improve student language testing scores, and would add a new way to test which schools are doing a good job of preparing their students.

Thus, while there have been shown and described and pointed out fundamental novel features of the invention as applied to preferred embodiments thereof, it will be understood that various omissions and substitutions and changes in the form and details of the devices and methods illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. A game method, at least partially implemented in a data processing system, for enabling a plurality of players to compete in a gameplay session, over a plurality of time-limited rounds, puzzle-based game, comprising a plurality of puzzle components each comprising a plurality of puzzle elements selected from the group consisting of pattern-matching puzzles and pattern-completion puzzles, each plural puzzle component having a respective predefined solution determinable by the plural players during gameplay in accordance with at least one corresponding predefined solution determination path, and further comprising at least one predefined scoring rule for correlating, for each plural puzzle component, the degree of progress made along the at least one corresponding predefined solution determination path toward determination of the respective predefined solution thereof during each particular plural round, to a corresponding puzzle solution score, the game method, comprising the steps of:

(a) providing, by the data processing system, at a start of each plural round of the gameplay session, at least one plural puzzle component selected from the plurality of puzzle components, to each corresponding plural player, wherein each said provided at least one plural puzzle component comprises plural puzzle elements that are common to respective plural puzzle elements of other at least one plural puzzle components provided to each said other corresponding plural player, and wherein each said provided at least one plural puzzle component is selected such that the respective predefined solution thereof is the same for all corresponding plural players;

(b) enabling, by the data processing system, each plural player to place a wager, at the onset of each plural round;

(c) enabling, by the data processing system during each round of the gameplay session and until a conclusion thereof, each plural player to interact with their corresponding assigned at least one plural puzzle component, to select a particular at least one corresponding predefined solution determination path, and to progress toward determination of the corresponding predefined solution thereof by solving at least a portion of said plural puzzle elements thereof;

(d) determining, prior to conclusion of the gameplay session, for each plural round thereof, by the data processing system in accordance with the at least one predefined scoring rule, each said plural round's puzzle solution score for each plural player that placed a wager at said step (b) previously performed during said plural round; and (e) determining at a conclusion of a last plural round of the gameplay session, by the data processing system, a total session score for each plural player that placed said wagers at previous performances of said step (b) during previous plural rounds, by calculating a sum total of said plural player's puzzle solution scores received during the gameplay session.

2. The game method of claim 1, further comprising, a step of:

(f) after said step (d), consolidating said plural wagers placed during performance of said step (b) during each plural round into a common gameplay award pool.

3. The game method of claim 2, further comprising, a step of:

(g) after said step (e), comparing said total session scores, and identifying a particular plural player having a highest total session score as a gameplay session winner and (h) awarding at least a portion of said common gameplay pool to said gameplay session winner.

4. The game method of claim 2, further comprising, as a prerequisite for participation in said gameplay session, a step of:

(i) requiring each plural player to provide, into said common gameplay award pool, a predetermined ante wager.

5. The game method of claim 1, wherein each plural pattern-matching puzzle component comprises a word search puzzle, and wherein each corresponding plurality of puzzle elements of each plural pattern-matching puzzle component, comprises a plurality of predefined words hidden in a particular pattern selected from a plurality of possible patterns.

6. The game method of claim 1, wherein each plural pattern-matching puzzle component comprises a sudoku-type puzzle, and wherein each corresponding plurality of puzzle elements of each plural pattern-matching puzzle component, comprises a plurality of predefined sudoku-type grid positions in a particular pattern, selected from a plurality of possible patterns.

7. The game method of claim 1, wherein the plural puzzle components each comprise a combination of both pattern-completion and pattern-matching properties forming a plural combination component, wherein each said plural combination component comprises a crossword-type puzzle, and wherein each corresponding plurality of puzzle elements of each plural crossword-type puzzle game component, comprises a plurality of predefined word answers positioned in a particular pattern, selected from a plurality of possible patterns.

8. The game method of claim 1, further comprising the step of:

(j) during performance of said step (c) during at least one plural round of the plurality of gameplay rounds, concealing from each said player, gameplay progress toward puzzle solution determination of all other plural players.

9. The game method of claim 1, further comprising the step of:

(k) during performance of said step (c) during at least one plural round of the plurality of gameplay rounds, partially concealing from each said player, gameplay progress toward puzzle solution determination of all other plural players.

10. A game method, at least partially implemented in a data processing system, for enabling a plurality of players to compete, over a plurality of rounds, in a puzzle-based game comprising at least one puzzle component, each having a corresponding solution, the game method comprising the steps of:

(a) providing at a start of a round of a gameplay session, by the data processing system, each at least one puzzle component to a corresponding plural player;

(b) enabling, by the data processing system during said round of said gameplay session and until a conclusion thereof, each plural player to interact with their corresponding assigned at least one puzzle component, to progress toward determination of the corresponding solution thereof;

(c) determining, by the data processing system in accordance with at least one predefined scoring rule, a score value for each plural player representative of their progress toward a successful determination of said at least one solution during said round of said gameplay session;

(d) enabling, after said step (c) each plural player to elect to remain an active player and continue playing in said gameplay session, by engaging in at least one predefined permitted risk-based action, or to exit said gameplay session otherwise;

(e) repeating, said steps (a) to (d) for each said active player, until a gameplay session conclusion criteria is met, and thereafter proceeding to a step (f); and (f) determining, at a conclusion of said gameplay session, at least one game winner from said remaining active players, having an accumulated highest total score value over said gameplay session.

11. The game method of claim 10, wherein at least a portion of the plural rounds of said gameplay session comprise a corresponding predefined time duration.

12. The game method of claim 10, further comprising the step of:

(g) after said step (c), and before said step (d), displaying, by the data processing system, to each plural player, their corresponding score value determined at said step (c).

13. The game method of claim 12, wherein said (g) further comprises the step of:

(h) after said step (c), and before said step (d), displaying, by the data processing system, to each plural player, score values of each then-active player.

14. The game method of claim 10, further comprising the step of:

(i) during performance of said step (b), selectively displaying, by the data processing system, gameplay progress of all said then-active players to one another.

15. The game method of claim 10, further comprising the step of:

(i) during performance of said step (b), concealing from each said then-active player, by the data processing system, gameplay progress of all other said then-active players.

16. The game method of claim 10, further comprising the step of:

(k) during performance of said step (b), partially obscuring from each said then-active player, by the data processing system, gameplay progress of all other said then-active players.

17. The game method of claim 10, wherein said predefined permitted risk-based action comprises the selective placement of a wager by a plural player.

18. The game method of claim 17, wherein said wager comprises at least one of: a selected amount of negotiable currency, a selected amount of virtual currency, and a selected magnitude of a virtual indicator of value.

19. The game method of claim 17, further comprising, as a prerequisite for participation in said gameplay session, a step of:

(l) requiring each plural player to provide into a common pool a predetermined ante wager.

20. The game method of claim 19, wherein said step (f) further comprises, the steps of:

(m) determining, by the data processing system, a total award pool amount by summation of all ante wagers and all subsequent gameplay session wagers; and (n) providing at least a portion of said total award pool to said game winner.

21. The game method of claim 20, wherein said step (f) further comprises, the step of (o) awarding a gameplay performance score to each of at least a portion of plural player participants in said gameplay session, determined in accordance with predefined scoring criteria.

22. The game method of claim 10, wherein said at least one puzzle component comprises at least one of: a pattern-matching puzzle game component, a pattern-completion puzzle game component, and a combination pattern matching and completion game component.

23. The game method of claim 22, wherein each said at least one pattern-matching puzzle game component comprises a plurality of puzzle pattern elements arranged in a predetermined pattern, said plurality of puzzle pattern elements also being arrangeable in a plurality of different unique patterns, further comprising the step of:

(p) prior to said step (a), generating, by the data processing system for each plural player, a corresponding puzzle game component comprising said plural puzzle pattern elements arranged in a unique pattern.

24. The game method of claim 22, wherein each said at least one pattern-matching puzzle game component comprises at least a partially different plurality of different puzzle pattern elements arranged in a predetermined pattern, further comprising the step of:

(q) prior to said step (a), generating, by the data processing system for each plural player, a corresponding puzzle game component comprising said at least a partially different set of plural puzzle pattern elements arranged in said predetermined pattern.

25. The game method of claim 22, wherein said pattern-matching puzzle game component comprises a word search puzzle game, wherein said pattern completion puzzle game component is selected from a group of puzzle games comprising: "sudoku", "Chinese Picture Puzzles", and "scrabble", and wherein said combination pattern matching and completion game component is selected from a group of puzzle games comprising: crossword-type puzzle games, and jigsaw-type puzzle games.

26. The game method of claim 10, wherein the data processing system comprises at least one distributed social network platform authorized to implement the puzzle-based game and to provide a plurality of corresponding interactive gameplay sessions to the plural players, and wherein said plural players comprise registered members of said at least one authorized social network platform.

27. The game method of claim 10, wherein the data processing system comprises at least one computer device, each having a predetermined software application installed thereon, collectively being operable to execute the steps of providing and playing said puzzle-based game.

28. The game method of claim 18, wherein the data processing system comprises at least one real money gaming apparatus comprising a suitable computer device for executing data processing functions, having a predetermined gameplay software application installed thereon, collectively being operable to execute the steps of providing and playing the puzzle-based game, and operable to enable a player interacting therewith to physically submit each said wager thereto during performance, by the apparatus, of each said gameplay session step requiring submission thereof, wherein at said step (f), said at least one winner receives a reward having real monetary value, and wherein:

in a first configuration, said at least one real money gaming apparatus is configured as a standalone system, in which said plural players comprise: a human player engaging said apparatus in gameplay and a computer opponent implemented in said predetermined gameplay software application; and in a second configuration, said at least one real money gaming apparatus is configured as one of a plurality of interconnected gaming apparatuses, in which said plural players comprise: a human player engaging said plural gaming apparatus in gameplay against at least one other human player engaging another plural gaming apparatuses.

29. A method for enabling provision and management of a multi-player competitive computer PBW Game Environment and infrastructure, implemented in a data processing system operable to interactively communicate with a plurality of other data processing systems, at least a portion of the plural other data processing systems corresponding to a plurality of users, the method comprising the steps of:

(a) providing a user-accessible interactive visual representation of a predefined gameplay environment;

(b) providing a plurality of predetermined user-selectable virtual gameplay sites, positioned within said visual gameplay environment representation, each said plural gameplay site comprising a corresponding interactive visual indicator, and each comprising at least one offered interactive game accessible to at least one user in accordance with at least one corresponding access criteria; and (c) providing a plurality of user-accessible interactive gameplay management functions at least partially integrated with said predefined gameplay environment and said plural gameplay sites, selectively operable to: enable, by at least one authorized user, administration of, and/or interaction with, at least a portion of said plural gameplay sites and further operable to: enable at least a portion of the plural users to browse said plural virtual gameplay sites, to interactively select at least one desired plural gameplay site, and to selectively engage in at least one corresponding interactive game offered therein wherein user utilization of at least one said plural game management function, comprises participation in at least one predetermined corresponding game aspect of said predefined gameplay environment, separate from said at least one interactive game, thereby enhancing an overall user gameplay experience.

30. The method of claim 29, wherein at least one of said at least one offered interactive game, comprises a competitive turn-based multi-player game, having wagering and puzzle-based features.

* * * * *